US009308636B2

(12) United States Patent
Wyler

(10) Patent No.: US 9,308,636 B2
(45) Date of Patent: Apr. 12, 2016

(54) ROTARY HAMMER WITH VIBRATION DAMPENING

(71) Applicant: Milwaukee Electric Tool Corporation, Brookfield, WI (US)

(72) Inventor: Andrew R. Wyler, Pewaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 603 days.

(21) Appl. No.: 13/757,090

(22) Filed: Feb. 1, 2013

(65) Prior Publication Data

US 2013/0199810 A1 Aug. 8, 2013

Related U.S. Application Data

(60) Provisional application No. 61/594,675, filed on Feb. 3, 2012, provisional application No. 61/737,304, filed on Dec. 14, 2012, provisional application No. 61/737,318, filed on Dec. 14, 2012.

(51) Int. Cl.
*B25D 17/24* (2006.01)
*B25F 5/02* (2006.01)
(Continued)

(52) U.S. Cl.
CPC ..... *B25D 17/24* (2013.01); *B25D 11/005* (2013.01); *B25D 11/125* (2013.01); *B25D 16/006* (2013.01); *B25D 17/043* (2013.01);
(Continued)

(58) Field of Classification Search
CPC . B25D 17/24; B25D 17/043; B25D 2250/371
USPC ..... 173/162.1, 162.2
See application file for complete search history.

(56) References Cited

U.S. PATENT DOCUMENTS 818,037 A 4/1906 Mickle
1,358,486 A 11/1920 Wilhelm
(Continued)

FOREIGN PATENT DOCUMENTS

DE 202007019329 10/2011
EP 0092596 8/1986
(Continued)

OTHER PUBLICATIONS

International Search Report and Written Opinion for Application No. PCT/US2014/045704 dated Oct. 28, 2014 (15 pages).
(Continued)

*Primary Examiner* — Michelle Lopez
(74) *Attorney, Agent, or Firm* — Michael Best & Friedrich LLP

(57) ABSTRACT

A rotary power tool includes a housing, a tool element defining a working axis, and a handle coupled to the housing. The handle is movable along a first axis parallel with the working axis between a retracted position and an extended position. The handle includes an upper portion and a lower portion. The rotary power tool also includes an upper joint coupling the upper portion of the handle to the housing and a lower joint coupling the lower portion of the handle to the housing. Each of the upper and lower joints includes a rod extending into the handle and a biasing member disposed between the handle and the housing. The biasing member is operable to bias the handle toward the extended position. Each of the upper and lower joints is operable to attenuate vibration transmitted along the first axis and along a second axis orthogonal to the first axis.

20 Claims, 16 Drawing Sheets

(51) Int. Cl.

| | |
|---|---|
| ***B25D 16/00*** | (2006.01) |
| ***B25D 11/12*** | (2006.01) |
| ***B25D 17/04*** | (2006.01) |
| ***B25D 11/00*** | (2006.01) |
| ***B25G 1/01*** | (2006.01) |

(52) U.S. Cl.

CPC ..... *B25G 1/01* (2013.01); *B25D 2216/0015* (2013.01); *B25D 2216/0023* (2013.01); *B25D 2216/0038* (2013.01); *B25D 2222/69* (2013.01); *B25D 2250/035* (2013.01); *B25D 2250/131* (2013.01)

(56) References Cited

U.S. PATENT DOCUMENTS

| | | | |
|---|---|---|---|
| 2,536,862 | A | 1/1951 | White |
| 3,114,421 | A | 12/1963 | McCloud |
| 3,174,599 | A | 3/1965 | Spyridakis et al. |
| 3,456,740 | A | 7/1969 | Paule et al. |
| 3,491,839 | A | 1/1970 | McIntire |
| 3,537,336 | A | 11/1970 | Schmuck |
| 3,546,663 | A | 12/1970 | Holmberg, Jr. |
| 3,552,499 | A | 1/1971 | Maurer |
| 3,610,344 | A | 10/1971 | Schoeps et al. |
| 3,616,883 | A | 11/1971 | Sindelar |
| 3,637,029 | A | 1/1972 | Sherwood, Jr. et al. |
| 3,710,646 | A | 1/1973 | Bogan |
| 3,727,483 | A | 4/1973 | Hanson et al. |
| 3,766,990 | A | 10/1973 | Eckman et al. |
| 3,837,758 | A | 9/1974 | Streicher |
| 3,874,460 | A | 4/1975 | Schmid et al. |
| 3,918,789 | A | 11/1975 | Davis |
| 3,937,036 | A | 2/1976 | Sauerwein |
| 3,955,044 | A | 5/1976 | Hoffman et al. |
| 3,974,885 | A | 8/1976 | Sudnishnikov et al. |
| 4,098,351 | A | 7/1978 | Alessio |
| 4,122,928 | A | 10/1978 | Smith |
| 4,207,953 | A | 6/1980 | Reibetanz et al. |
| 4,265,320 | A | 5/1981 | Tanaka et al. |
| 4,276,675 | A | 7/1981 | Pioch |
| 4,354,779 | A | 10/1982 | Vaughan |
| 4,368,556 | A | 1/1983 | Wanner et al. |
| 4,450,921 | A | 5/1984 | Arvidsson et al. |
| 4,479,555 | A | 10/1984 | Grossmann et al. |
| 4,820,090 | A | 4/1989 | Chen |
| 4,825,548 | A | 5/1989 | Driggers |
| 4,881,294 | A | 11/1989 | Riedl |
| 4,924,988 | A | 5/1990 | Page |
| 5,004,054 | A | 4/1991 | Sheen |
| 5,005,682 | A | 4/1991 | Young et al. |
| 5,025,870 | A | 6/1991 | Gantner |
| 5,027,910 | A | 7/1991 | Honsa et al. |
| 5,031,323 | A | 7/1991 | Honsa et al. |
| 5,049,012 | A | 9/1991 | Cavedo |
| 5,052,112 | A | 10/1991 | MacDonald |
| 5,054,562 | A | 10/1991 | Honsa et al. |
| 5,054,588 | A | 10/1991 | Thorp et al. |
| 5,090,499 | A | 2/1992 | Cuneo |
| 5,094,636 | A | 3/1992 | Zinn et al. |
| 5,111,890 | A | 5/1992 | Ranger et al. |
| 5,125,461 | A | 6/1992 | Hoser |
| 5,159,986 | A | 11/1992 | Hoser |
| 5,207,121 | A | 5/1993 | Bien |
| 5,338,229 | A | 8/1994 | Egenolf |
| 5,343,961 | A | 9/1994 | Ichikawa |
| 5,375,666 | A | 12/1994 | Pettet et al. |
| 5,435,397 | A | 7/1995 | Demuth |
| 5,437,566 | A | 8/1995 | Zinn et al. |
| 5,465,492 | A | 11/1995 | Bond |
| 5,505,676 | A | 4/1996 | Bookshar |
| 5,588,903 | A | 12/1996 | Pennison |
| 5,664,634 | A | 9/1997 | McCracken |
| 5,690,451 | A | 11/1997 | Thurler et al. |
| 5,697,456 | A | 12/1997 | Radle et al. |
| 5,706,902 | A | 1/1998 | Eisenhardt |
| 5,738,177 | A | 4/1998 | Schell et al. |
| 5,775,440 | A | 7/1998 | Shinma |
| 5,836,219 | A | 11/1998 | Klingler et al. |
| 5,873,418 | A | 2/1999 | Arakawa et al. |
| 5,947,211 | A | 9/1999 | Jakobsson |
| 5,954,140 | A | 9/1999 | Bauer |
| 5,975,217 | A | 11/1999 | Frenzel et al. |
| 6,035,945 | A | 3/2000 | Ichijyou et al. |
| 6,065,905 | A | 5/2000 | Kinton |
| 6,076,616 | A | 6/2000 | Kramp et al. |
| 6,085,849 | A | 7/2000 | Scigliuto |
| 6,105,463 | A | 8/2000 | Sporrer |
| 6,109,364 | A | 8/2000 | Demuth et al. |
| 6,116,352 | A | 9/2000 | Frauhammer et al. |
| 6,126,495 | A | 10/2000 | Lolic et al. |
| 6,132,435 | A | 10/2000 | Young |
| 6,192,996 | B1 | 2/2001 | Sakaguchi et al. |
| 6,220,367 | B1 | 4/2001 | Masterson et al. |
| 6,223,833 | B1 | 5/2001 | Thurler et al. |
| 6,253,640 | B1 | 7/2001 | Phillips |
| 6,283,890 | B1 | 9/2001 | Schleuder et al. |
| 6,305,481 | B1 | 10/2001 | Yamazaki et al. |
| 6,325,604 | B1 | 12/2001 | Du |
| 6,382,888 | B2 | 5/2002 | Cook |
| 6,431,290 | B1 | 8/2002 | Muhr et al. |
| 6,460,627 | B1 | 10/2002 | Below et al. |
| 6,467,555 | B2 | 10/2002 | Plank et al. |
| 6,520,270 | B2 | 2/2003 | Wissmach et al. |
| 6,523,658 | B2 | 2/2003 | Furuta et al. |
| 6,530,138 | B2 | 3/2003 | Phillips |
| 6,550,546 | B2 | 4/2003 | Thurler et al. |
| 6,557,648 | B2 | 5/2003 | Ichijyou et al. |
| 6,587,184 | B2 | 7/2003 | Wursch et al. |
| 6,595,300 | B2 | 7/2003 | Milbourne |
| 6,609,860 | B2 | 8/2003 | Wanek et al. |
| 6,688,406 | B1 | 2/2004 | Wu et al. |
| 6,691,796 | B1 | 2/2004 | Wu |
| 6,691,849 | B1 | 2/2004 | Dyson et al. |
| 6,863,479 | B2 | 3/2005 | Frauhammer et al. |
| 6,913,088 | B2 | 7/2005 | Berger |
| 6,971,455 | B2 | 12/2005 | Shibata et al. |
| 6,997,761 | B2 | 2/2006 | Lutsch et al. |
| 7,021,401 | B2 | 4/2006 | Droste et al. |
| 7,039,986 | B2 | 5/2006 | Glenn et al. |
| 7,040,413 | B2 | 5/2006 | Mueller et al. |
| 7,070,008 | B2 | 7/2006 | Baumann et al. |
| 7,076,838 | B2 | 7/2006 | Meixner |
| 7,100,706 | B2 | 9/2006 | Meixner et al. |
| 7,121,360 | B2 | 10/2006 | Funfer |
| 7,144,206 | B2 | 12/2006 | Burger et al. |
| 7,174,969 | B2 | 2/2007 | Droste |
| 7,175,487 | B2 | 2/2007 | Urbaniak et al. |
| 7,201,235 | B2 | 4/2007 | Umemura et al. |
| 7,201,643 | B2 | 4/2007 | Dineen et al. |
| 7,204,744 | B2 | 4/2007 | Lamprecht et al. |
| 7,217,178 | B2 | 5/2007 | Oki et al. |
| 7,222,709 | B2 | 5/2007 | Arnault |
| 7,252,156 | B2 | 8/2007 | Sugiyama et al. |
| 7,287,600 | B2 | 10/2007 | Braun |
| 7,287,601 | B2 | 10/2007 | Hellbach et al. |
| 7,296,635 | B2 | 11/2007 | Droste |
| 7,306,048 | B2 | 12/2007 | Yamazaki |
| 7,325,624 | B2 | 2/2008 | Yamazaki |
| 7,334,647 | B2 | 2/2008 | Hahn |
| 7,363,685 | B2 | 4/2008 | Walker et al. |
| 7,395,872 | B2 | 7/2008 | Duesselberg et al. |
| 7,398,835 | B2 | 7/2008 | Stirm |
| 7,422,075 | B2 | 9/2008 | Hahn |
| 7,462,080 | B2 | 12/2008 | Shiraishi et al. |
| 7,469,752 | B2 | 12/2008 | Furusawa et al. |
| 7,472,760 | B2 | 1/2009 | Stirm et al. |
| RE40,643 | E | 2/2009 | Stirm |
| 7,506,694 | B2 | 3/2009 | Stirm et al. |
| 7,523,790 | B2 | 4/2009 | Arakawa et al. |
| 7,591,324 | B2 | 9/2009 | Saur |
| 7,610,968 | B1 | 11/2009 | Honsa |
| 7,624,815 | B2 | 12/2009 | Friedrich et al. |
| 7,635,032 | B2 | 12/2009 | Saur et al. |

(56) References Cited

U.S. PATENT DOCUMENTS

| | | | |
|---|---|---|---|
| 7,665,392 | B2 | 2/2010 | Tokunaga et al. |
| 7,721,818 | B2 | 5/2010 | Inagawa et al. |
| 7,726,414 | B2 | 6/2010 | Berger et al. |
| 7,762,348 | B2 | 7/2010 | Stirm et al. |
| 7,766,096 | B2 | 8/2010 | Satou et al. |
| 7,789,168 | B2 | 9/2010 | Becht et al. |
| 7,828,074 | B2 | 11/2010 | Tsubakimoto et al. |
| 7,828,185 | B2 | 11/2010 | Hofmann et al. |
| 7,836,971 | B2 | 11/2010 | Kikuchi et al. |
| 7,857,074 | B2 | 12/2010 | Meixner |
| 7,866,411 | B2 | 1/2011 | Rondahl |
| 7,878,264 | B2 | 2/2011 | Koch et al. |
| 7,886,838 | B2 | 2/2011 | Hahn |
| 7,886,839 | B2 | 2/2011 | Frauhammer et al. |
| 7,886,841 | B2 | 2/2011 | Armstrong |
| 7,921,935 | B2 | 4/2011 | Engelfried et al. |
| 7,931,095 | B2 | 4/2011 | Machida et al. |
| 7,971,655 | B2 | 7/2011 | Steinke et al. |
| 7,971,656 | B2 | 7/2011 | Engelfried et al. |
| 7,987,921 | B2 | 8/2011 | Hahn |
| 8,016,047 | B2 | 9/2011 | Ookubo et al. |
| 8,028,760 | B2 | 10/2011 | Yoshikane |
| 8,051,922 | B2 | 11/2011 | Ohlendorf et al. |
| 8,057,267 | B2 | 11/2011 | Johnescu |
| 8,061,438 | B2 | 11/2011 | Schmid et al. |
| 8,069,930 | B2 | 12/2011 | Engelfried |
| 8,082,634 | B2 | 12/2011 | Frank et al. |
| 8,087,424 | B2 | 1/2012 | Swartzentruber et al. |
| 8,087,472 | B2 | 1/2012 | Usselman et al. |
| 8,091,651 | B2 | 1/2012 | Kuhnle et al. |
| 8,127,862 | B2 | 3/2012 | Aoki |
| 8,132,296 | B2 | 3/2012 | Di Nicolantonio |
| 8,162,075 | B2 | 4/2012 | Roberts et al. |
| 8,210,276 | B2 | 7/2012 | Krondorfer et al. |
| 8,225,514 | B2 | 7/2012 | Guip et al. |
| 8,234,756 | B2 | 8/2012 | Hahn et al. |
| 8,235,138 | B2 | 8/2012 | Aoki |
| 8,240,395 | B2 | 8/2012 | Kamegai et al. |
| 8,277,249 | B2 | 10/2012 | Koga |
| 8,282,426 | B2 | 10/2012 | Zweigle |
| 8,286,724 | B2 | 10/2012 | Furusawa et al. |
| 8,316,957 | B2 | 11/2012 | Kuhnle et al. |
| 8,327,949 | B2 | 12/2012 | Meixner |
| 8,342,894 | B2 | 1/2013 | Uchiyama et al. |
| 2003/0006051 | A1 | 1/2003 | Schmitzer et al. |
| 2004/0127108 | A1 | 7/2004 | Ferre Giro et al. |
| 2004/0163214 | A1 | 8/2004 | Cheng |
| 2005/0284646 | A1 | 12/2005 | Bacila |
| 2006/0219418 | A1 | 10/2006 | Arakawa et al. |
| 2007/0034397 | A1 | 2/2007 | Fischer et al. |
| 2007/0107920 | A1 | 5/2007 | Keller |
| 2007/0215369 | A1 | 9/2007 | Stark et al. |
| 2007/0224492 | A1 | 9/2007 | Scott et al. |
| 2008/0099222 | A1 | 5/2008 | Ranger et al. |
| 2008/0169111 | A1 | 7/2008 | Duesselberg et al. |
| 2008/0196910 | A1 | 8/2008 | Radle et al. |
| 2009/0049651 | A1 | 2/2009 | Roberts et al. |
| 2009/0075528 | A1 | 3/2009 | Osborn, Jr. et al. |
| 2009/0126959 | A1 | 5/2009 | Stark et al. |
| 2009/0133544 | A1 | 5/2009 | Hofbrucker et al. |
| 2009/0145618 | A1 | 6/2009 | Duesselberg et al. |
| 2009/0159304 | A1 | 6/2009 | Teranishi et al. |
| 2009/0188691 | A1 | 7/2009 | Hahn |
| 2009/0188692 | A1 | 7/2009 | Hahn et al. |
| 2009/0266198 | A1 | 10/2009 | Nosakowski |
| 2009/0283282 | A1 | 11/2009 | Zimmermann |
| 2009/0308626 | A1 | 12/2009 | Saur |
| 2010/0012339 | A1 | 1/2010 | Hahn et al. |
| 2010/0051303 | A1 | 3/2010 | Ullrich et al. |
| 2010/0206594 | A1 | 8/2010 | Meixner |
| 2010/0206595 | A1 | 8/2010 | Kamegai |
| 2010/0270046 | A1 | 10/2010 | Schlesak et al. |
| 2010/0282484 | A1 | 11/2010 | Moessnang et al. |
| 2010/0307783 | A1 | 12/2010 | Baumann et al. |
| 2011/0005791 | A1 | 1/2011 | Baumann et al. |
| 2011/0024149 | A1 | 2/2011 | Hecht et al. |
| 2011/0025207 | A1 | 2/2011 | Nagasaka et al. |
| 2011/0072946 | A1 | 3/2011 | Bernardi et al. |
| 2011/0127056 | A1* | 6/2011 | Friedrich ..... B25D 17/043 173/162.2 |
| 2011/0131766 | A1 | 6/2011 | Imaschewski et al. |
| 2011/0132630 | A1 | 6/2011 | Kawamura et al. |
| 2011/0139477 | A1 | 6/2011 | Kuhnle et al. |
| 2011/0162860 | A1 | 7/2011 | Gut et al. |
| 2011/0192469 | A1 | 8/2011 | Yamashita et al. |
| 2011/0277589 | A1 | 11/2011 | Leibold et al. |
| 2012/0012353 | A1 | 1/2012 | Foerster et al. |
| 2012/0055689 | A1 | 3/2012 | Wierer et al. |
| 2012/0123417 | A1 | 5/2012 | Smith |
| 2012/0211250 | A1 | 8/2012 | Yamauchi |
| 2012/0244759 | A1 | 9/2012 | Tsuji |
| 2012/0279740 | A1 | 11/2012 | Furusawa et al. |
| 2012/0298392 | A1 | 11/2012 | Weiss |
| 2012/0305278 | A1 | 12/2012 | Esenwein |
| 2012/0312571 | A1 | 12/2012 | Nemetz et al. |
| 2012/0312572 | A1 | 12/2012 | Nemetz et al. |
| 2013/0098648 | A1 | 4/2013 | Furusawa et al. |

FOREIGN PATENT DOCUMENTS

| | | |
|---|---|---|
| EP | 0117848 | 4/1987 |
| EP | 1529603 | 5/2005 |
| EP | 1129825 | 11/2005 |
| EP | 1911547 | 4/2008 |
| EP | 1674212 | 5/2008 |
| EP | 1674214 | 5/2008 |
| EP | 1674215 | 6/2008 |
| EP | 1675708 | 9/2009 |
| EP | 1938924 | 7/2010 |
| GB | 2431133 | 4/2007 |
| WO | 2008026987 | 3/2008 |
| WO | 2009063186 | 5/2009 |
| WO | 2011107143 | 9/2011 |

OTHER PUBLICATIONS

HR2811F Parts Breakdown, Makita, Aug. 18, 2010, 3 pages.

PCT/US2013/024383 International Search Report and Written Opinion dated May 15, 2013 (10 pages).

* cited by examiner

ROTARY HAMMER WITH VIBRATION DAMPENING

CROSS-REFERENCE TO RELATED APPLICATIONS

This application claims priority to U.S. Provisional Patent Application No. 61/594,675 filed on Feb. 3, 2012, Application No. 61/737,304 filed on Dec. 14, 2012, and Application No. 61/737,318 filed on Dec. 14, 2012, the entire contents of all of which are incorporated herein by reference.

FIELD OF THE INVENTION

The present invention relates to power tools, and more particularly to rotary hammers.

BACKGROUND OF THE INVENTION

Rotary hammers typically include a rotatable spindle, a reciprocating piston within the spindle, and a striker that is selectively reciprocable within the piston in response to an air pocket developed between the piston and the striker. Rotary hammers also typically include an anvil that is impacted by the striker when the striker reciprocates within the piston. The impact between the striker and the anvil is transferred to a tool bit, causing it to reciprocate for performing work on a work piece. This reciprocation may cause undesirable vibrations that may be transmitted to a user of the rotary hammer.

SUMMARY OF THE INVENTION

The invention provides, in one aspect, a rotary power tool including a housing, a tool element defining a working axis, and a handle coupled to the housing. The handle is movable along a first axis parallel with the working axis between a retracted position and an extended position relative to the housing. The handle includes an upper portion and a lower portion. The rotary power tool also includes an upper joint coupling the upper portion of the handle to the housing and a lower joint coupling the lower portion of the handle to the housing. Each of the upper and lower joints includes a rod extending into the handle and a biasing member disposed between the handle and the housing. The biasing member is operable to bias the handle toward the extended position. Each of the upper and lower joints is operable to attenuate vibration transmitted along the first axis and along a second axis orthogonal to the first axis.

The invention provides, in another aspect, a rotary hammer adapted to impart axial impacts to a tool bit. The rotary hammer includes a motor, a spindle coupled to the motor for receiving torque from the motor, a piston at least partially received within the spindle for reciprocation therein, a striker received within the spindle for reciprocation in response to reciprocation of the piston, and an anvil received within the spindle and positioned between the striker and the tool bit. The anvil imparts axial impacts to the tool bit in response to reciprocation of the striker. The rotary hammer also includes a synchronizing assembly operable in a first configuration in which the motor is drivably coupled to the piston for reciprocating the piston, and a second configuration in which the piston is decoupled from the motor. The rotary hammer further includes an actuator operable for switching the synchronizing assembly from the second configuration to the first configuration in response to depressing the tool bit against a workpiece.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
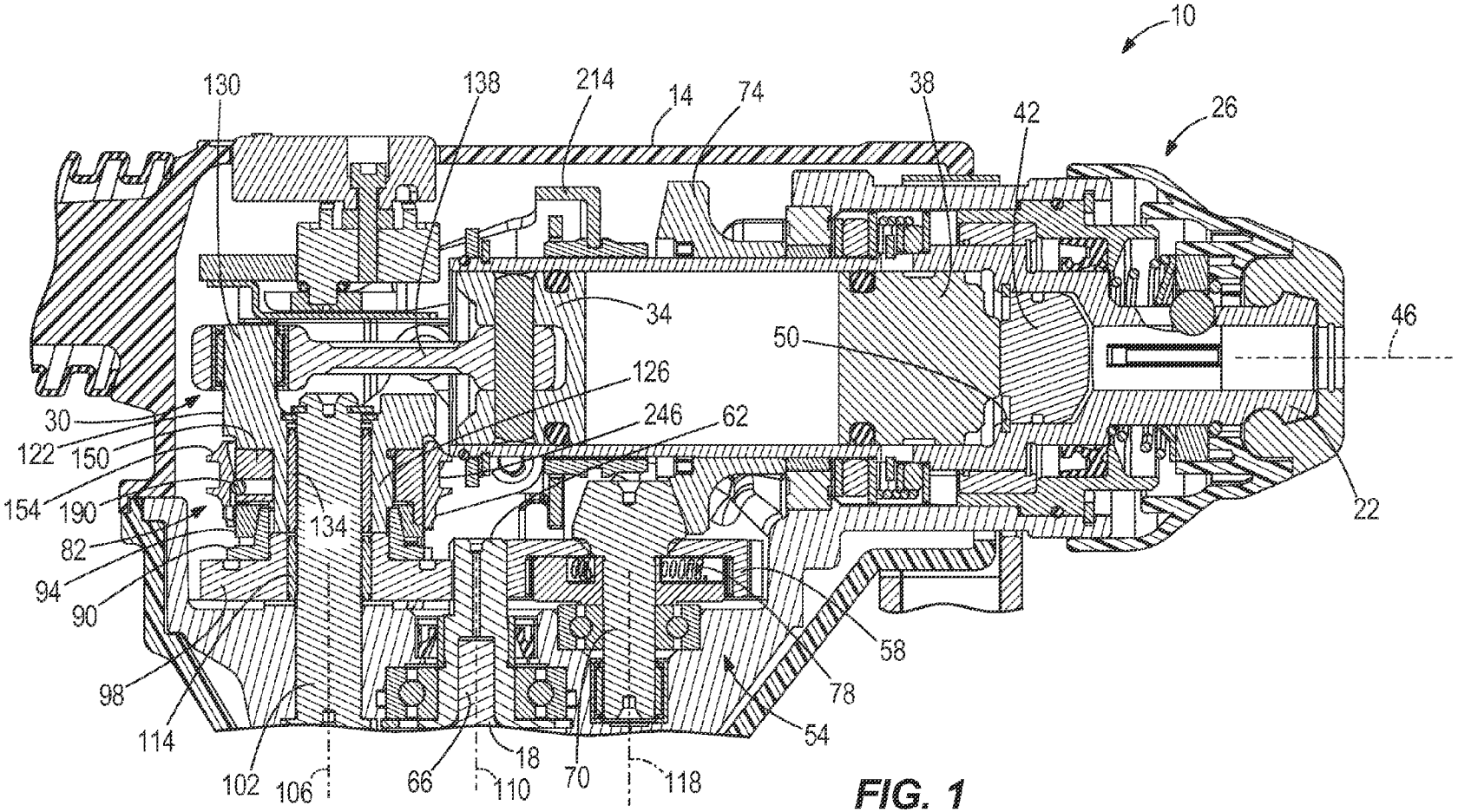
FIG. 1 is a cross-sectional view of a portion of a rotary hammer of the invention.

FIG. 1 illustrates a portion of a rotary hammer 10 according to an embodiment of the invention. The rotary hammer 10 includes a housing 14, a motor 18 disposed within the housing 14, and a rotatable spindle 22 coupled to the motor 18 for receiving torque from the motor 18. Although not shown, a tool bit may be secured to the spindle 22 for co-rotation with the spindle 22 (e.g., using a spline or a hex fit). In the illustrated construction, the rotary hammer 10 includes a quick-release mechanism 26 coupled for co-rotation with the spindle 22 to facilitate quick removal and replacement of different tool bits. The tool bit may include a necked section or a groove in which a detent member of the quick-release mechanism 26 is received to constrain axial movement of the tool bit to the length of the necked section or groove.

The motor 18 is configured as a DC motor that receives power from an on-board power source (e.g., a battery). The battery may include any of a number of different nominal voltages (e.g., 12V, 18V, etc.), and may be configured having any of a number of different chemistries (e.g., lithium-ion, nickel-cadmium, etc.). Alternatively, the motor 18 may be powered by a remote power source (e.g., a household electrical outlet) through a power cord. The motor 18 is selectively activated by depressing a trigger (not shown) which, in turn, actuates an electrical switch. The switch may be electrically connected to the motor 18 via a top-level or master controller, or one or more circuits, for controlling operation of the motor 18.

The rotary hammer 10 further includes an impact mechanism 30 having a reciprocating piston 34 disposed within the spindle 22, a striker 38 that is selectively reciprocable within the spindle 22 in response to reciprocation of the piston 34, and an anvil 42 that is impacted by the striker 38 when the striker reciprocates toward the tool bit. The impact between the striker 38 and the anvil 42 is transferred to the tool bit, causing it to reciprocate for performing work on a work piece. As will be discussed in more detail below, an air pocket is developed between the piston 34 and the striker 38 when the piston 34 reciprocates within the spindle 22, whereby expansion and contraction of the air pocket induces reciprocation of the striker 38.

With continued reference to FIG. 1, the spindle 22 is axially movable along a longitudinal axis 46 from an extended position (shown in FIGS. 1 and 15) to a retracted position (FIG. 16) in response to depressing the tool bit against the workpiece. Particularly, axial movement of the anvil 42 is constrained in a rearward direction by a clip 50 (FIG. 1) secured to the inner periphery of the spindle 22. As such, the tool bit and the anvil 42 may move rearward in an unconstrained manner until the anvil 42 engages the clip 50, after which the tool bit, the anvil 42, and the spindle 22 may move rearward against the bias of a biasing member (e.g., one or more compressible O-rings, a compression spring, etc.). The biasing member(s), therefore, bias the spindle 22 forward toward the extended position shown in FIG. 1.

Torque from the motor 18 may be transferred to the spindle 22 by a transmission 54. In the illustrated construction of the rotary hammer 10, the transmission 54 includes an input gear 58 engaged with a pinion 62 coupled to an output shaft 66 of the motor 18, an intermediate pinion 70 coupled for co-rotation with the input gear 58, and an output gear 74 coupled for co-rotation with the spindle 22 and engaged with the intermediate pinion 70. The output gear 74 is secured to the spindle 22 using a spline-fit or a key and keyway arrangement, for example, that facilitates axial movement of the spindle 22 relative to the output gear 74 yet prevents relative rotation between the spindle 22 and the output gear 74. A clutch mechanism 78 may be incorporated with the input gear 58 to vary the amount of torque that may be transferred from the motor 18 to the spindle 22.

With continued reference to FIG. 1, the rotary hammer 10 also includes a synchronizing assembly 82 operable in a first configuration in which the motor 18 is drivably coupled to the piston 34 for reciprocating the piston 34, and a second configuration in which the piston 34 is decoupled from the motor 18. The rotary hammer 10 further includes an actuator 86 (FIG. 13) operable for switching the synchronizing assembly 82 from the second configuration to the first configuration in response to depressing the tool bit against a workpiece. The synchronizing assembly 82, therefore, automatically activates the impact mechanism 30 in response to the tool bit contacting a workpiece. Likewise, the synchronizing assembly 82 automatically deactivates the impact mechanism 30 in response to the tool bit being lifted from the workpiece.

With reference to FIG. 1, the synchronizing assembly 82 includes a first clutch ring 90 coupled to the motor 18 for continuous rotation therewith when the motor 18 is activated and a second clutch ring 94 which, during a transition phase from the second configuration of the synchronizing assembly 82 to the first configuration, is engaged with the first clutch ring 90 for co-rotation therewith and, in the second configuration of the synchronizing assembly 82, is substantially disengaged from the first clutch ring 90 and non-rotatable with the first clutch ring 90. In the illustrated construction of the rotary hammer 10, the first clutch ring 90 is coupled for co-rotation with a second input gear 98 which, in turn, is meshed with the motor pinion 62. Particularly, the first clutch ring 90 is interference fit or press fit to the input gear 98. Alternatively, the first clutch ring 90 may be integrally formed with the input gear 98 as a single piece, or coupled for co-rotation with the input gear 98 in any of a number of different manners (e.g., using a spline or key and keyway arrangement, etc.).

The input gear 98 is rotatably supported within the housing on a stationary intermediate shaft 102, which defines a central axis 106 that is offset from a rotational axis 110 of the motor output shaft 66 and pinion 62, by a bearing 114 (e.g., a roller bearing, a bushing, etc.). As shown in FIG. 1, the respective axes 106, 110 of the intermediate shaft 102 and the motor output shaft 66 are parallel. Likewise, respective axes 110, 118 of the motor output shaft 66 and the intermediate pinion 70 are also parallel. The impact mechanism 30 also includes a crank shaft 122 having a hub 126 and an eccentric pin 130 coupled to the hub 126. The hub 126 is rotatably supported on the stationary shaft 102 above the input gear 98 by a bearing 134 (e.g., a roller bearing, a bushing, etc.). The impact mechanism 30 further includes a connecting rod 178 interconnecting the piston 34 and the eccentric pin 130.

Figure 5:
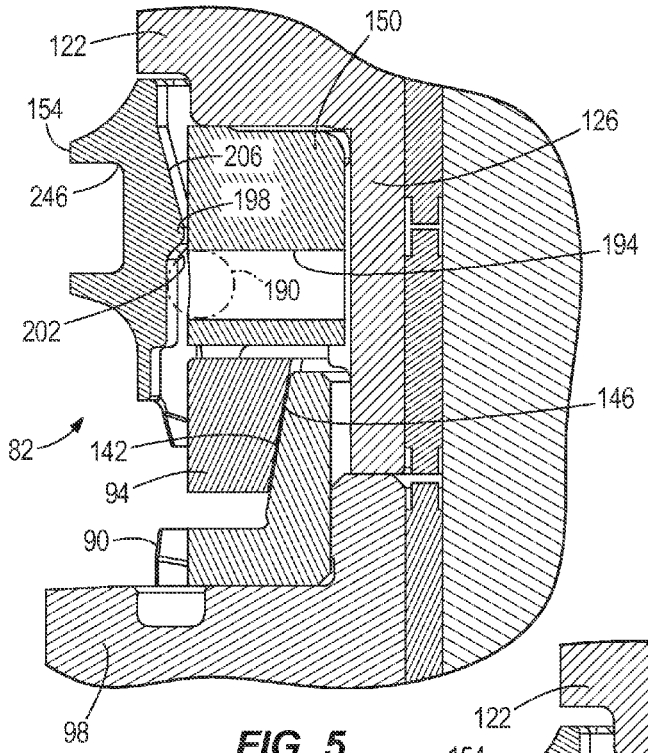
FIG. 5 is an enlarged, cross-sectional view of the synchronizing assembly of FIG. 2 illustrating the synchronizing assembly in a second configuration.
Figure 6:
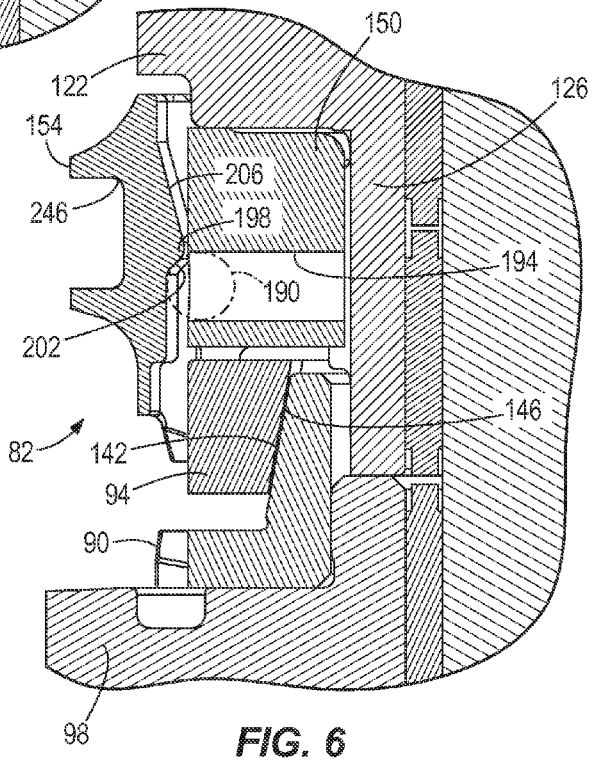
FIG. 6 is an enlarged, cross-sectional view of the synchronizing assembly of FIG. 2 illustrating the synchronizing assembly during a transition phase from the second configuration to a first configuration.
Figure 7:
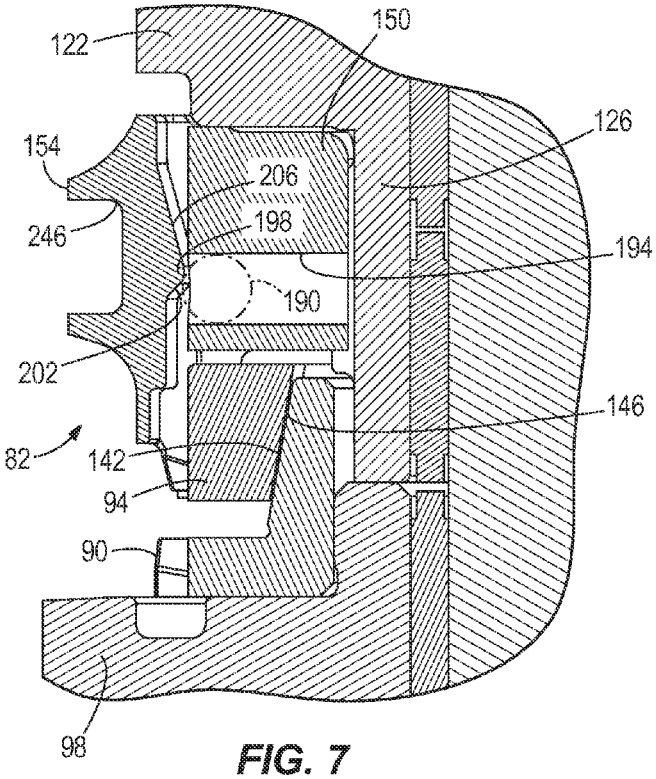
FIG. 7 is an enlarged, cross-sectional view of the synchronizing assembly of FIG. 2 illustrating the synchronizing assembly during the transition phase.

With reference to FIGS. 2, 5-7, 9, and 11, the first clutch ring 90 includes an exterior conical surface 142, and the second clutch ring 94 includes a corresponding interior conical surface 146 engaged with the exterior conical surface 142 when the synchronizing assembly 82 is in the transition phase (FIGS. 6 and 7). The engaged conical surfaces 142, 146, therefore, wedge against each other to ensure that the first and second clutch rings 90, 94 co-rotate when the synchronizing assembly 82 is in the transition phase. As is described in more detail below, the second clutch ring 94 is axially movable relative to the first clutch ring 90 when the synchronizing assembly 82 is actuated between the first and second configurations. As such, when the synchronizing assembly 82 is in the transition phase between the first and second configurations, the conical surfaces 142, 146 of the clutch rings 90, 94, respectively, wedge against each other for transferring torque to the crank shaft 122. The second clutch ring 94 is axially displaced from the first clutch ring 90 a sufficient amount in the second configuration of the synchronizing assembly 82, thereby maintaining a gap between the conical surfaces 142, 146, to substantially inhibit torque transfer to the crank shaft 122. Although not shown, a resilient member (e.g., a compression spring) may be positioned between the first and second clutch rings 90, 94 for biasing the second clutch ring 94 away from the first clutch ring 90. Alternatively, the first clutch ring 90 may include an interior conical surface engageable with an exterior conical surface of the second clutch ring 94.

Figure 2:
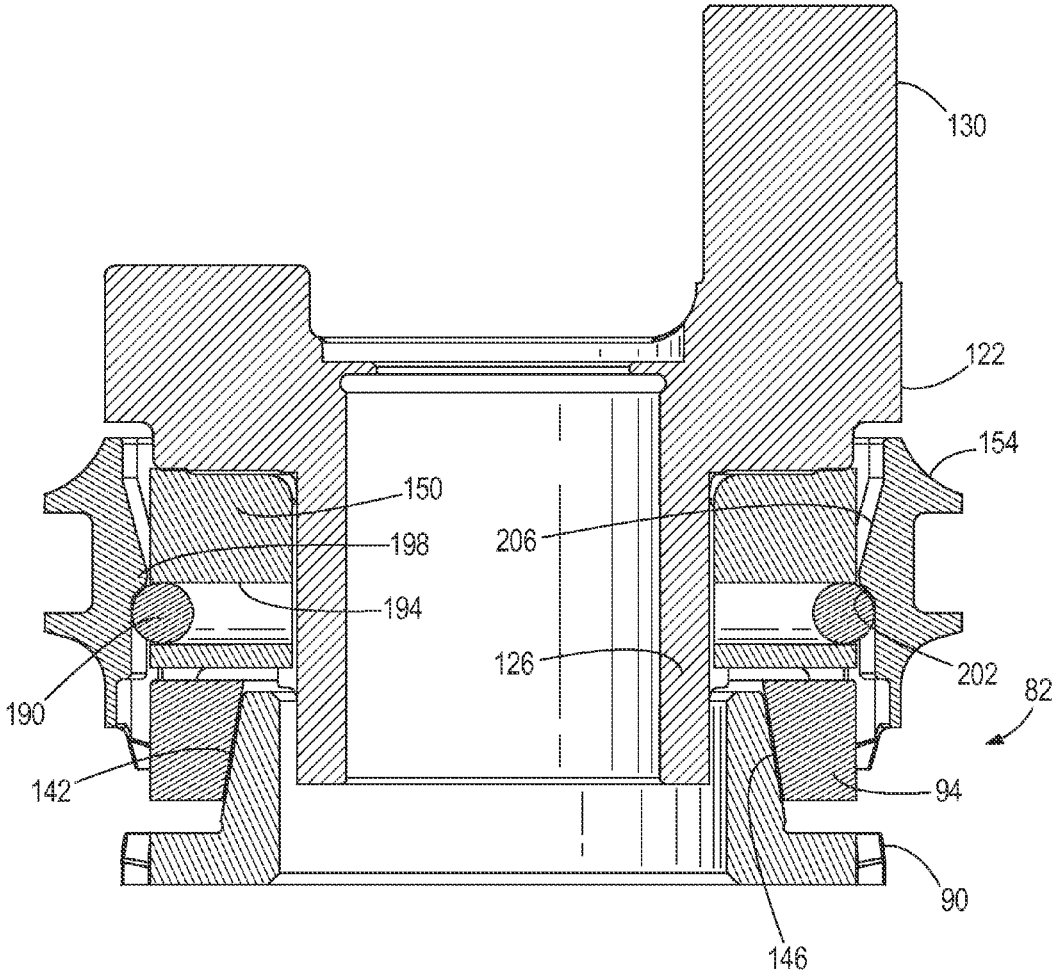
FIG. 2 is a cross-sectional view of a crankshaft and a synchronizing assembly of the rotary hammer of FIG. 1.
Figure 3:
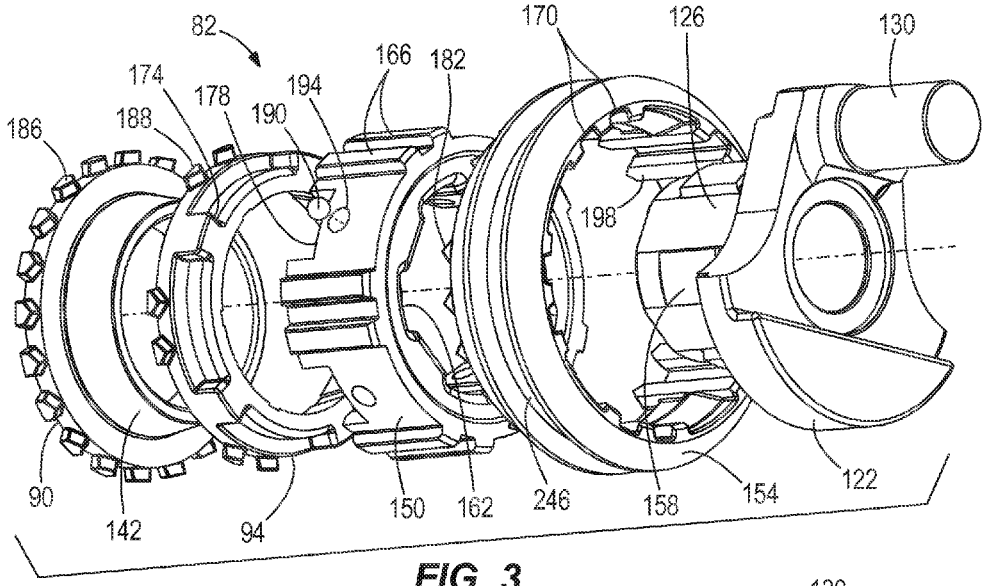
FIG. 3 is an exploded, top perspective view of the crankshaft and synchronizing assembly of FIG. 2.

With reference to FIGS. 1-7, 9, and 11, the synchronizing assembly 82 also includes a synchronizer hub 150 coupled for co-rotation with the crank shaft hub 126 and a shift sleeve 154 positioned around the synchronizer hub 150. In the illustrated construction of the rotary hammer 10, the crank shaft hub 126 includes radially outwardly extending projections 158 that are received within corresponding grooves 162 on the inner peripheral surface of the synchronizer hub 150 (FIG. 4) for coupling the synchronizer hub 150 and the crank shaft hub 126 for co-rotation. The shift sleeve 154 is also coupled for co-rotation with the synchronizer hub 150. Particularly, the synchronizer hub 150 includes spaced pairs of radially outwardly extending projections 166 that are received within corresponding grooves 170 on the inner peripheral surface of the shift sleeve 154 (FIG. 3). In other words, each of the grooves 170 in the shift sleeve 154 receives a single pair of the radially outwardly extending projections 166 on the synchronizer hub 150.

Furthermore, the second clutch ring 94 is coupled to the synchronizer hub 150 for limited relative rotation therewith. Specifically, with continued reference to FIG. 3, the second clutch ring 94 includes upwardly extending projections 174 that are received within corresponding downwardly extending grooves or recesses 178 in a lower edge of the synchronizer hub 150. The recesses 178 in the synchronizer hub 150, however, are wider than the projections 174 on the second clutch ring 94 such that the second clutch ring 94 may rotate relative to the synchronizer hub 150 a limited amount. After such limited relative rotation, the projections 174 contact the sides of the respective recesses 178 to thereby rotationally interlock the synchronizer hub 150 and the second clutch ring 94 so long as the hub 150 and ring 94 co-rotate in the same direction.

With reference to FIGS. 5-7, 9, and 11, the shift sleeve 154 is axially movable on the synchronizer hub 150 due to sliding engagement of the projections 166 within the grooves 170 between a first position (FIG. 11) coinciding with the first configuration of the synchronizing assembly 82, and a second position (FIG. 5) coinciding with the second configuration of the synchronizing assembly 82. The intermediate positions of the shift sleeve 154 shown in FIGS. 6, 7, and 9 coincide with the transition phase of the synchronizing assembly 82, which is described in more detail below. With reference to FIGS. 3, 4, 8, 10, 12, 13, and 14, the shift sleeve 154 also includes teeth 182 that extend toward the first clutch ring 90, while the first clutch ring 90 includes corresponding teeth 186 located about the periphery of the exterior conical surface 142. As described in more detail below, the teeth 182, 186 are engaged when the shift sleeve 154 is moved to the first position, thereby keying the shift sleeve 154 to the first clutch ring 90 to rotationally interlock the shift sleeve 154 and the first clutch ring 90, and therefore the crank shaft 122 and the second input gear 98, respectively. The synchronizing assembly 82, therefore, assumes the first configuration when the shift sleeve 154 is moved to the first position shown in FIGS. 11, 12, and 16. The second clutch ring 94 also includes teeth 188 located about its outer periphery, the purpose of which is described in detail below.

Figure 4:
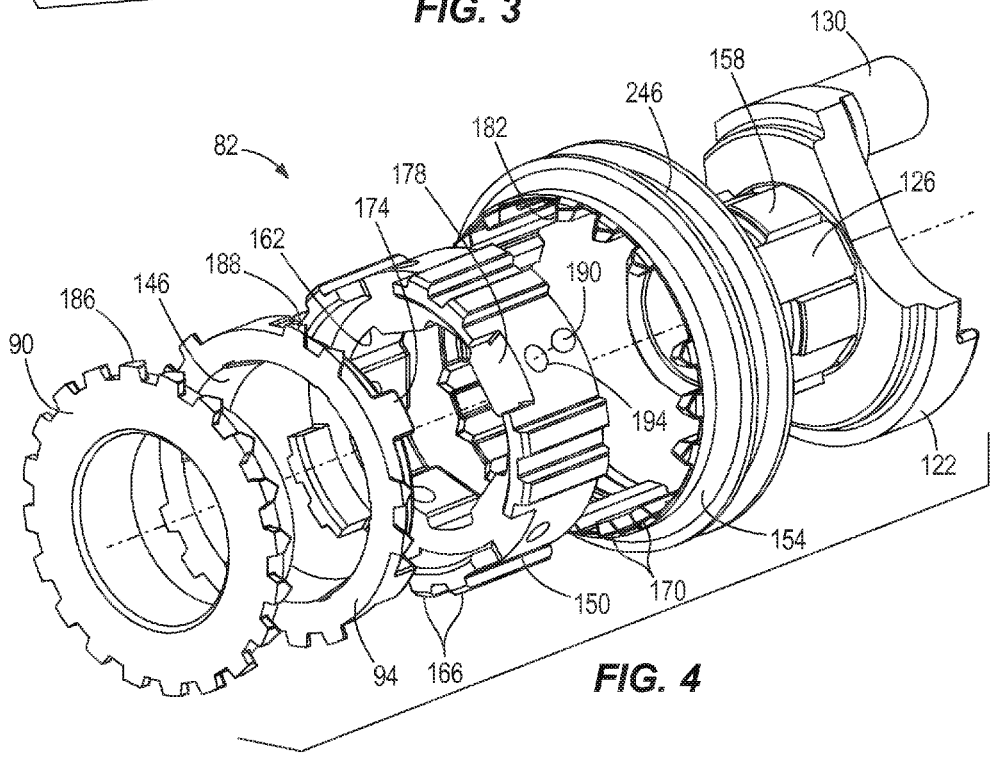
FIG. 4 is an exploded, bottom perspective view of the crankshaft and synchronizing assembly of FIG. 2.

With reference to FIGS. 2-4, the synchronizing assembly 82 further includes a detent arrangement that is operable during the transition phase of the synchronizing assembly 82 to transfer a downward force from the shift sleeve 154 to the synchronizer hub 150, from the frame of reference of FIG. 2, to initiate wedging of the conical surfaces 142, 146 of the respective clutch rings 90, 94. In the illustrated construction of the rotary hammer 10, the detent arrangement includes a ball detent 190 situated within a radial bore 194 in the synchronizer hub 150. A resilient member (e.g., a compression spring, not shown) is positioned between the crank shaft hub 126 and the ball detent 190 for biasing the ball detent 190 radially outwardly toward the shift sleeve 154. The detent arrangement also includes a radially inwardly extending protrusion 198 on an inner peripheral surface of the shift sleeve 154 that is engageable by the ball detent 190. Particularly, the protrusion 198 includes a lower surface 202 that is engageable by the ball detent 190 during the transition phase of the synchronizing assembly 82, and an upper surface 206 that is engaged by the ball detent 190 to maintain the shift sleeve 154 in the first position (FIG. 11) coinciding with the first configuration of the synchronizing assembly 82. Alternatively, the ball detent 190 may be supported on the shift sleeve 154, and the protrusion 198 may be formed on the synchronizer hub 150. As a further alternative, the detent arrangement may be configured in any of a number of different ways.

The actuator 86 is pivotably coupled to the housing 14 and interconnects the spindle 22 and the shift sleeve 154 such that axial movement of the spindle 22 from the extended position (FIGS. 1 and 15) to the retracted position (FIG. 16) causes the shift sleeve 154 to move from the second position to the first position. Particularly, the actuator 86 is configured to redirect axial movement of the spindle 22 along the longitudinal axis 46 to the shift sleeve 154 in a substantially normal direction along the central axis 106 of the intermediate shaft 102.

Figure 13:
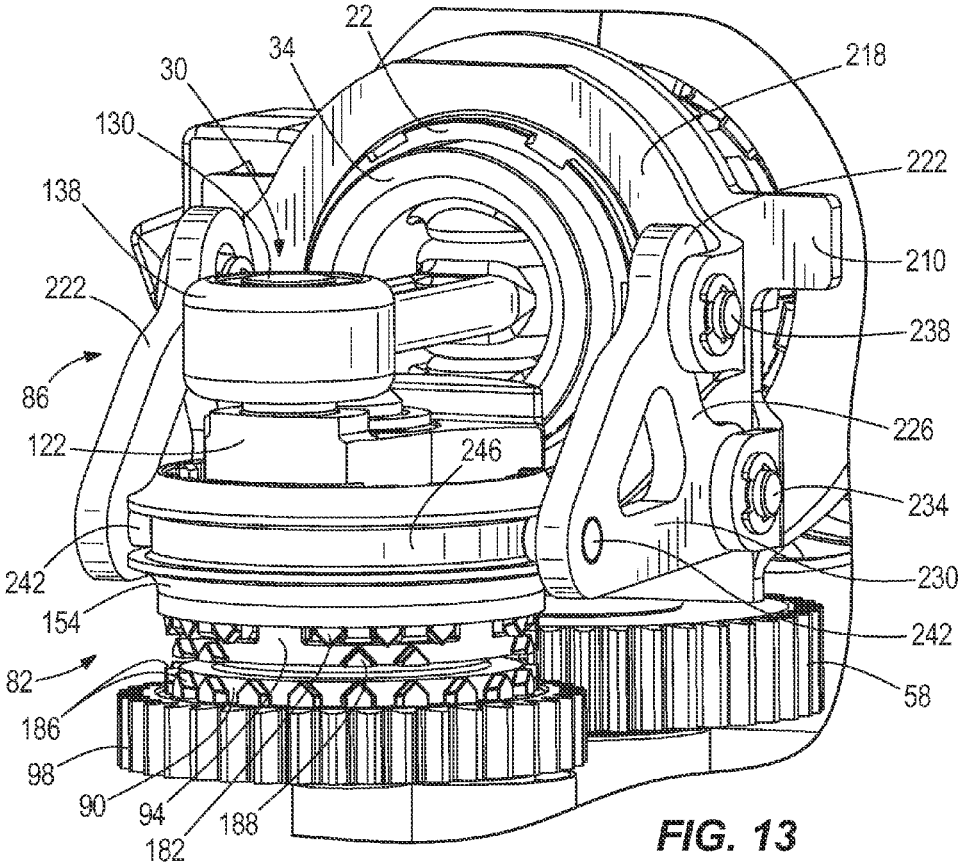
FIG. 13 is an enlarged, rear perspective view of the synchronizing assembly of FIG. 2 illustrating the synchronizing assembly in the second configuration.
Figure 14:
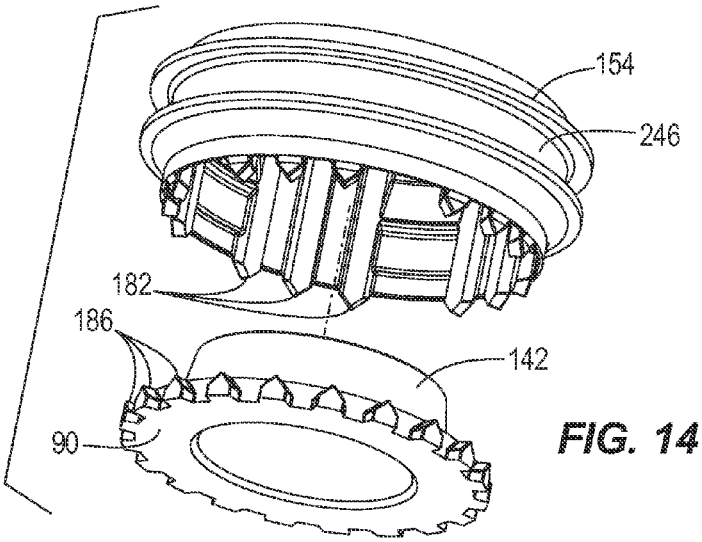
FIG. 14 is a perspective view of two components of the synchronizing assembly of FIG. 2.

With reference to FIG. 13, the rotary hammer 10 includes a bracket 210 fixed to a transmission housing 214 (FIG. 1) of the rotary hammer 10. Accordingly, the bracket 210 is stationary with respect to the transmission housing 214 and the outer housing 14. The actuator 86 includes a plate 218 (FIG. 13) coupled for axial movement with the spindle 22, and two pivot arms 222 located on opposite sides of the spindle 22. The plate 218 is movable with the spindle 22 as it slides back and forth along the longitudinal axis 46. Each pivot arm 222 includes a first arm portion 226 coupled to the spindle 22 and a second arm portion 230 coupled to the shift sleeve 154. Particularly, the first arm portion 226 is defined between respective first and second pins 234, 238 on each of the pivot arms 222 that are pivotably coupled to the bracket 210 and the plate 218, while the second arm portion 230 is defined between the first pin 234 and a third pin 242 on each of the pivot arms 222. The third pin 242 of each of the pivot arms 222 is received within a circumferential groove 246 on an outer periphery of the shift sleeve 154, such that the pins 242 slide within the groove 246 when the shift sleeve 154 is rotating. The first and second arm portions 226, 230 of each of the pivot arms 222 share a common pivot (i.e., about the first pin 234) relative to the housing 14.

Figure 15:
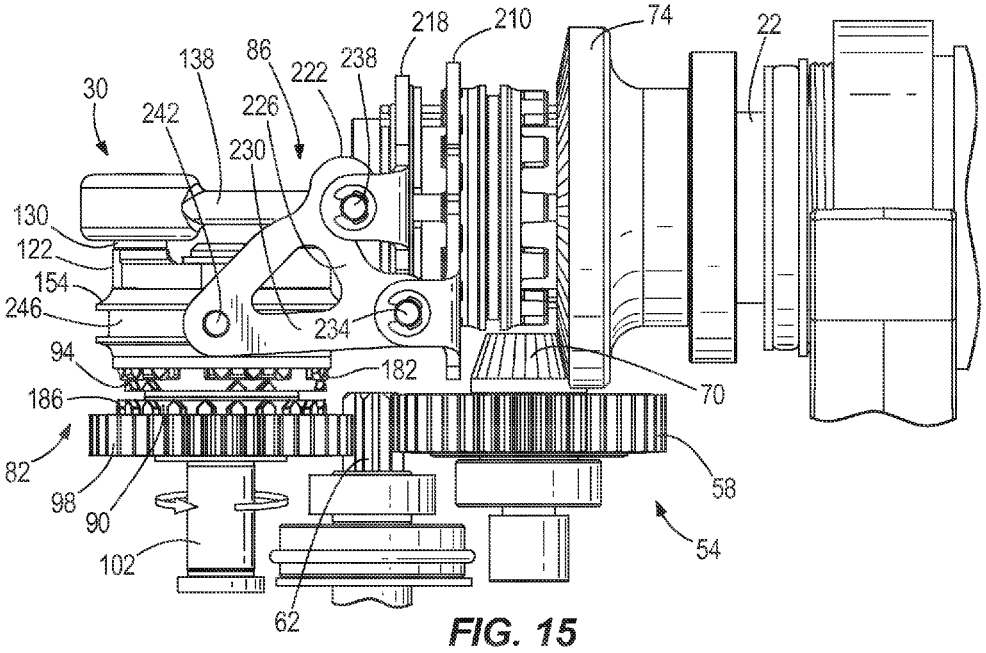
FIG. 15 is a side view of the synchronizing assembly of FIG. 2 shown in the second configuration.
Figure 16:
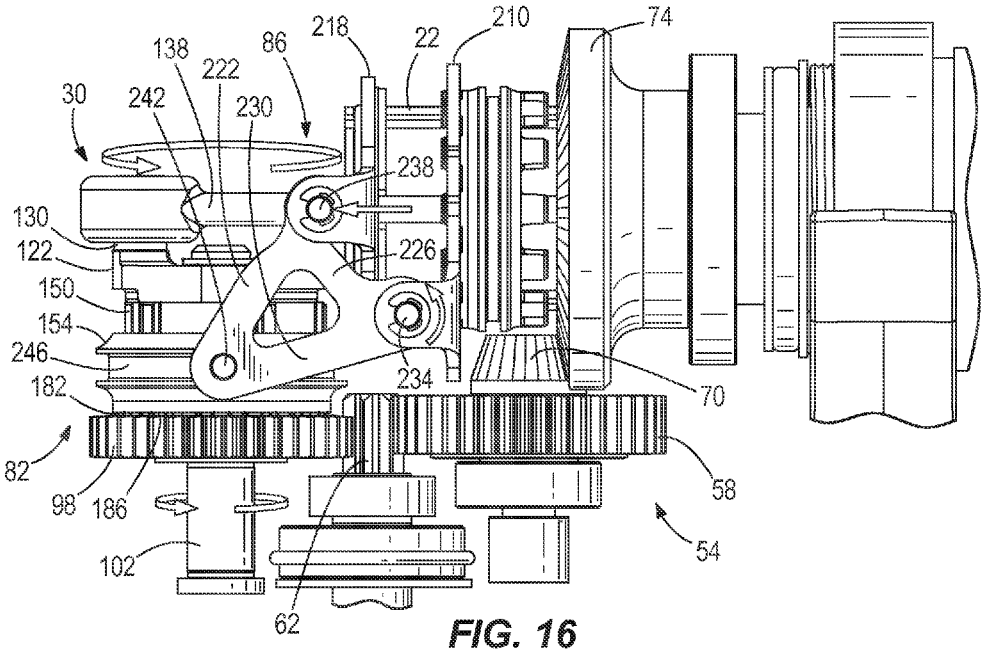
FIG. 16 is a side view of the synchronizing assembly of FIG. 2 shown in the first configuration.

Prior to depressing the tool bit in the rotary hammer 10 against a workpiece, the shift sleeve 154 is maintained in the second position shown in FIGS. 5 and 15 by the pivot arms 222 which, in turn, are maintained in the position shown in FIG. 15 when the spindle 22 is in its extended position. Accordingly, the lower surface 202 of the protrusion 198 is spaced from the ball detent 190 (FIG. 5). The synchronizing assembly 82, therefore, is maintained in the second configuration when the spindle 22 is in its extended position. Although not shown, the resilient member (e.g., a compression spring) positioned between the first and second clutch rings 90, 94 biases the second clutch ring 94 away from the first clutch ring 90 to provide a small gap or spacing between the conical surfaces 142, 146 of the respective clutch rings 90, 94. Accordingly, torque transfer from the first clutch ring 90 to the second clutch ring 94 is inhibited, with the second clutch ring 94, the synchronizer hub 150, the shift sleeve 154, and the crankshaft 122 remaining stationary while the first clutch ring 90 and the input gear 98 are continuously rotated by the motor 18 when the motor 18 is activated.

When the tool bit in the rotary hammer 10 is depressed against a workpiece, the tool bit pushes the anvil 42, and therefore the spindle 22 (via the clip 50), rearward from the frame of reference of FIG. 1. The actuator 86 redirects the rearward axial movement of the spindle 22 to the shift sleeve 154, displacing the shift sleeve 154 downward from the second position (FIG. 5) to initiate the transition phase of the synchronizing assembly 82. Particularly, each of the pivot arms 222 is pivoted in a counter-clockwise direction from the frame of reference of FIGS. 15 and 16 (i.e., about the coaxial pivot axes of the first pins 234 of the corresponding pivot arms 222), thereby axially displacing the shift sleeve 154 downward via the third pins 242 which, in turn, are slidably received within the circumferential groove 246 of the shift sleeve 154. Initially upon displacement of the shift sleeve 154, the lower surface 202 of the protrusion 198 engages the ball detents 190 in the synchronizer hub 150 (FIG. 6). Continued downward displacement of the shift sleeve 154 exerts a downward force on the ball detents 190 and therefore the synchronizer hub 150 which, in turn, exerts a downward force on the second clutch ring 94 to close the gap between the conical surfaces 142, 146 of the respective clutch rings 90, 94.

After the gap between the conical surfaces 142, 146 of the respective clutch rings 90, 94 is closed, the clutch rings 90, 94 become frictionally engaged via the wedged conical surfaces 142, 146. Because the first clutch ring 90 is continuously rotating with the input gear 98, the frictional engagement initially accelerates the second clutch ring 94 to rotate in the same direction as the first clutch ring 90. Shortly thereafter, the projections 174 on the second clutch ring 94 contact the sides of the respective recesses 178 in the synchronizer hub 150 to thereby rotationally interlock the synchronizer hub 150 and the second clutch ring 94. After this time, the second clutch ring 94, the synchronizer hub 150, the shift sleeve 154, and the crankshaft 122 are rotationally accelerated in unison to "catch-up" with the rotating first clutch ring 90.

Figure 8:
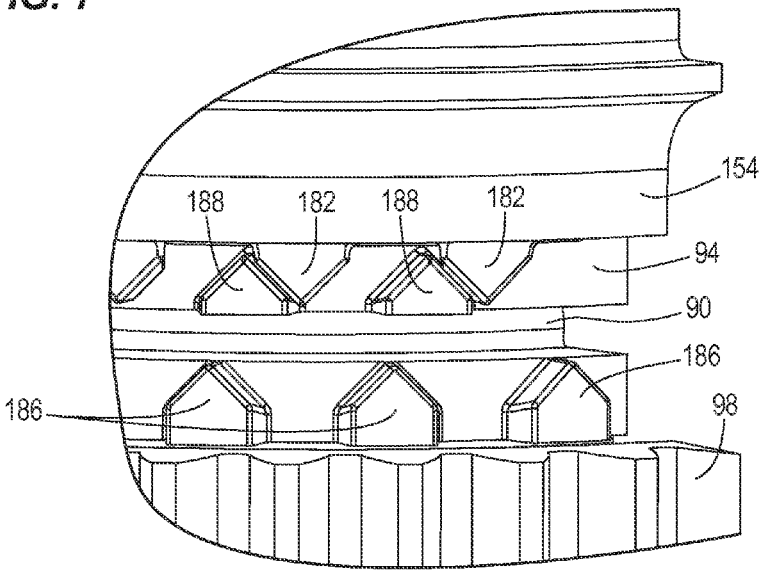
FIG. 8 is an enlarged, assembled plan view of the synchronizing assembly shown in FIG. 7.

With reference to FIGS. 7 and 8, continued downward displacement of the shift sleeve 154 during the transition phase of the synchronizer assembly 82 causes the ball detents 190 to slide over the lower surface 202 of the protrusion 198 and retract into the radial bore 194. As the ball detents 190 slide over the apex of the protrusion 198 between the lower and upper surfaces 202, 206, the shift sleeve 154 no longer exerts a downward force on the second clutch ring 94 via the ball detents 190 and the synchronizer hub 150. Rather, at this time, the teeth 182 on the shift sleeve 154 engage corresponding teeth 188 on the second clutch ring 94 (FIG. 8) and directly impart a downward force on the second clutch ring 94 to continue the frictional engagement between the conical surfaces 142, 146 of the respective clutch rings 90, 94. Particularly, inclined surfaces of the respective teeth 182, 188 engage to provide a vertical component of force acting downwardly on the second clutch ring 94.

Figure 9:
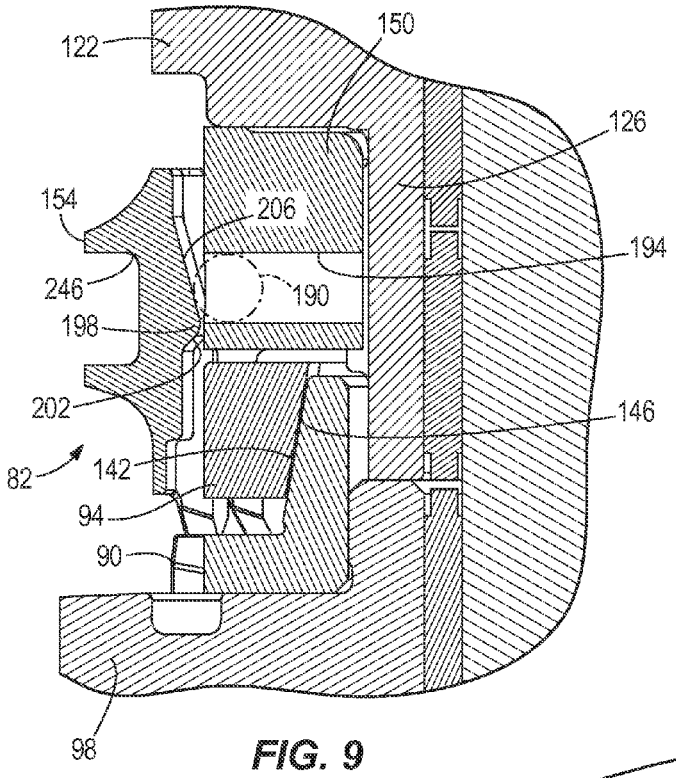
FIG. 9 is an enlarged, cross-sectional view of the synchronizing assembly of FIG. 2 illustrating the synchronizing assembly during the transition phase.
Figure 10:
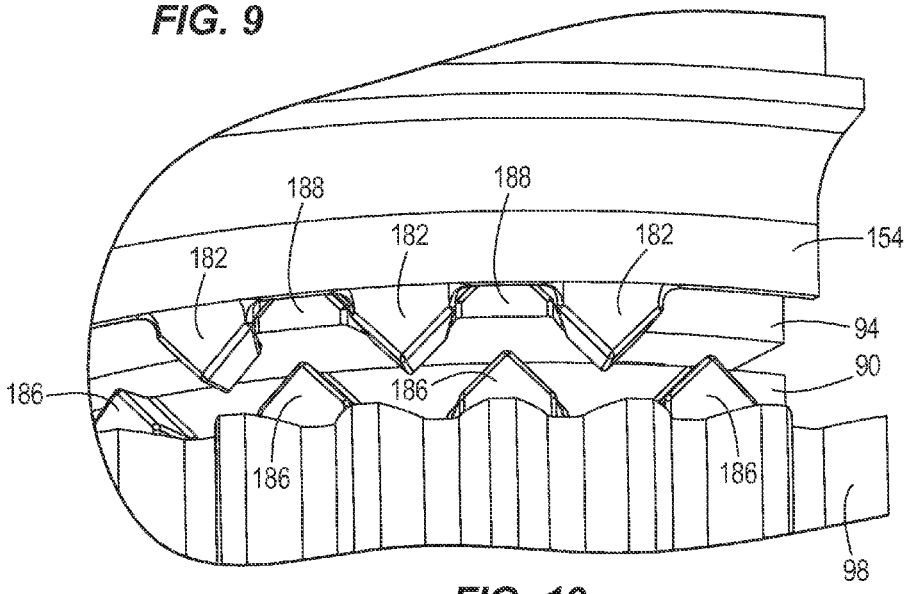
FIG. 10 is an enlarged, assembled perspective view of the synchronizing assembly shown in FIG. 9.

With reference to FIGS. 9 and 10, further downward displacement of the shift sleeve 154 during the transition phase of the synchronizer assembly 82 causes the second clutch ring 94 to incrementally rotate due to the tangential component of force acting on the second clutch ring 94 as a result of the contact between the inclined surfaces of the respective teeth 182, 188. As shown in FIG. 10, the second clutch ring 94 continues to incrementally rotate until the teeth 188 on the second clutch ring 94 are wholly contained between adjacent teeth 182 on the shift sleeve 154. The ball detents 190 may be engaged with the upper surface 206 of the protrusion 198 at this time during the transition phase, but need not be (FIG. 9).

Figure 11:
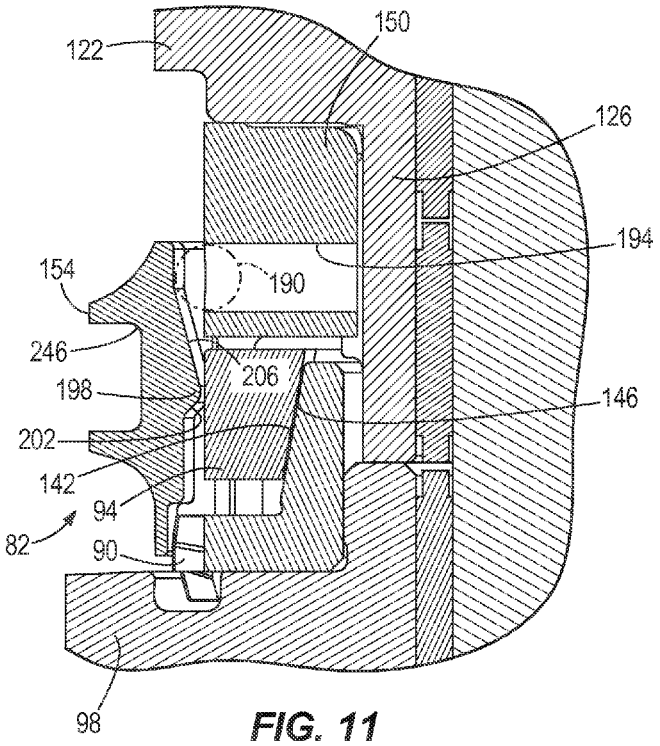
FIG. 11 is an enlarged, cross-sectional view of the synchronizing assembly of FIG. 2 illustrating the synchronizing assembly in the first configuration.
Figure 12:
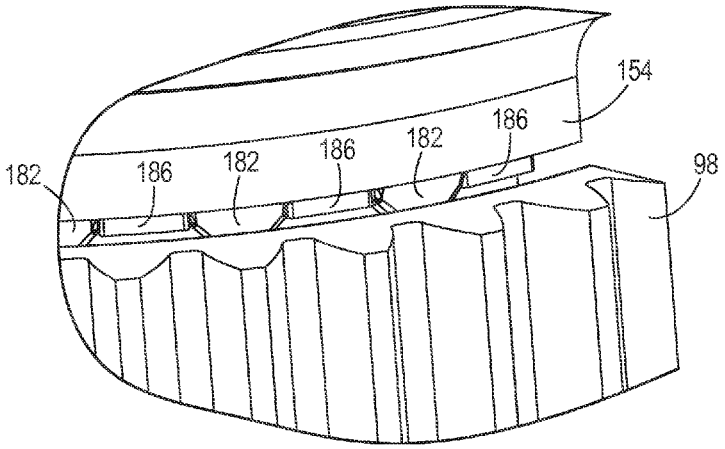
FIG. 12 is an enlarged, assembled perspective view of the synchronizing assembly shown in FIG. 11.

With reference to FIGS. 11 and 12, the transition phase of the synchronizing assembly 82 is completed when the corresponding teeth 182, 186 on the shift sleeve 154 and the first clutch ring 90 engage to rotationally interlock or key the shift sleeve 154 and the first clutch ring 90 (FIG. 12). The synchronizing assembly 82, thereafter, is considered to be in the first configuration in which the crankshaft 122 rotates in unison with the first clutch ring 90 and the input gear 98.

As such, the synchronizing assembly 82 facilitates acceleration of the impact mechanism 30 over a period of time (i.e., the amount of time occurring between movement of the shift sleeve 154 from the second position shown in FIG. 5 to the first position shown in FIG. 11) prior to rotationally interlocking the impact mechanism 30 and the motor 18. Thereafter, the rotating crank shaft 122 reciprocates the piston 34 within the spindle 22 for operating the rotary hammer 10 in a "hammer-drill" mode or a "hammer-only" mode in which the piston 34 reciprocates within the spindle 22 to draw the striker 38 rearward and then accelerate it towards the anvil 42 for impact (e.g., via an air pocket developed between the piston 34 and the striker 38). The impact between the striker 38 and the anvil 42 is subsequently transferred to the tool bit for performing work on the work piece.

When the tool bit is removed from the workpiece, the rotary hammer 10 may transition from the hammer-drill or hammer-only mode to an "idle" mode, in which the spindle 22 is permitted to return to its extended position, thereby returning the shift sleeve 154 to the second position (FIG. 5) and frictionally de-coupling the clutch rings 90, 94. Torque transfer to the crank shaft 122 is therefore interrupted, halting further reciprocation of the piston 34 within the spindle 22 and subsequent impacts between the striker 38 and the anvil 42. The rotary hammer 10 may thereafter be operated in a "drill-only" mode in which the spindle 22 and the attached tool bit are rotated, but the impact mechanism 30 is deactivated. The rotary hammer 10 may include a switch (not shown) that selectively inhibits rearward movement of the spindle 22 in response to depressing the tool bit against a workpiece, thereby maintaining the rotary hammer 10 in the "drill-only" mode.

Depressing the tool bit against the workpiece (with the optional switch toggled to not interfere with the spindle 22) to push the anvil 42 and the spindle 22 rearward causes the rotary hammer 10 to transition back to the hammer-drill or hammer-only modes.

Figure 17:
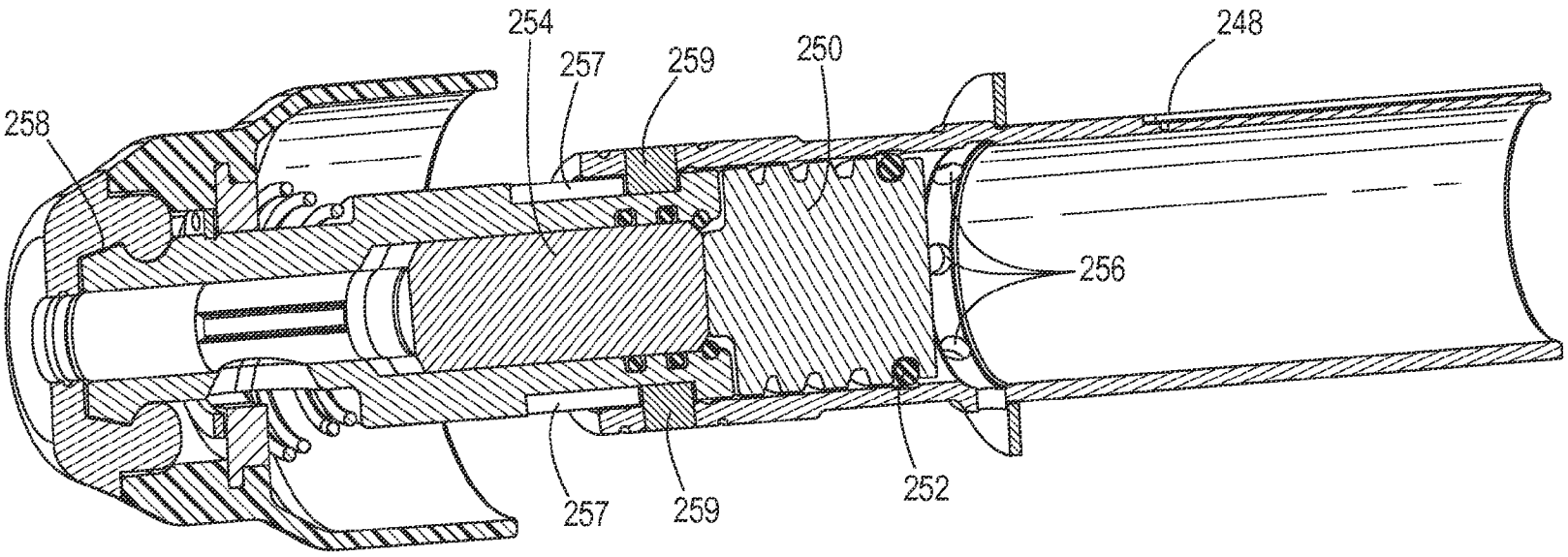
FIG. 17 is a cross-sectional view of a portion of a rotary hammer according to another embodiment of the invention.

FIG. 17 illustrates a rotatable spindle 248 and a striker 250 of a rotary hammer according to another embodiment of the invention. This embodiment employs much of the same structure and has many of the same properties as the embodiment of the rotary hammer 10 described above in connection with FIGS. 1-16. Accordingly, the following description focuses primarily upon the structure and features that are different than the embodiment described above in connection with FIGS. 1-16.

An O-ring 252 is received within a corresponding groove in the striker 250. The rotary hammer also includes a reciprocating piston (not shown) rearward of the striker 250 and that is driven by an electric motor (not shown) and a transmission (not shown), and an anvil 254 that is impacted by the striker 250 and which transfers the impact to a tool bit (not shown). The spindle 248 includes a set of idle ports 256 that fluidly communicate the interior of the spindle 248 with the atmosphere when the striker 250 is in the position shown in FIG. 17. The rotary hammer also includes a tool holder 258 in which the tool bit is received and that is axially movable relative to the spindle 248. Particularly, the tool holder 258 includes multiple axially extending grooves 257 in which corresponding keys 259 secured to the spindle 248 are received.

When the tool bit of the rotary hammer is depressed against a workpiece, the tool bit pushes the tool holder 258 and the striker 250 rearward (i.e., to the right from the frame of reference of FIG. 17) with respect to the spindle 248, far enough to block the idle ports 256 with the striker 250. In this "impact" position of the striker 250, an air pocket is formed between the striker 250 and the reciprocating piston. During operation of the rotary hammer in a "hammer" mode in which the idle ports 256 are blocked by the striker 250, the piston reciprocates within the spindle 248 to draw the striker 250 rearward and then accelerate it towards the anvil 254 for impact.

When the tool bit is removed from the workpiece, the rotary hammer may transition from the hammer mode to an "idle" mode, in which the tool holder 258 and striker 250 resume their positions shown in FIG. 17 in which the idle ports 256 are uncovered by the striker 250 to de-pressurize the interior of the spindle 248 between the striker 250 and the piston. As the spindle 248 is depressurized, the striker 250 is decelerated and comes to rest. Continued reciprocation of the piston is therefore permitted without drawing the striker 250 back to the previously described impact position. Rather, air is alternately drawn and expelled through the idle ports 256 while the piston reciprocates. Depressing the tool bit against the workpiece to push the tool holder 258 and the striker 250 rearward to again block the idle ports 256 causes the rotary hammer to transition back to the "hammer" mode.

Figure 18:
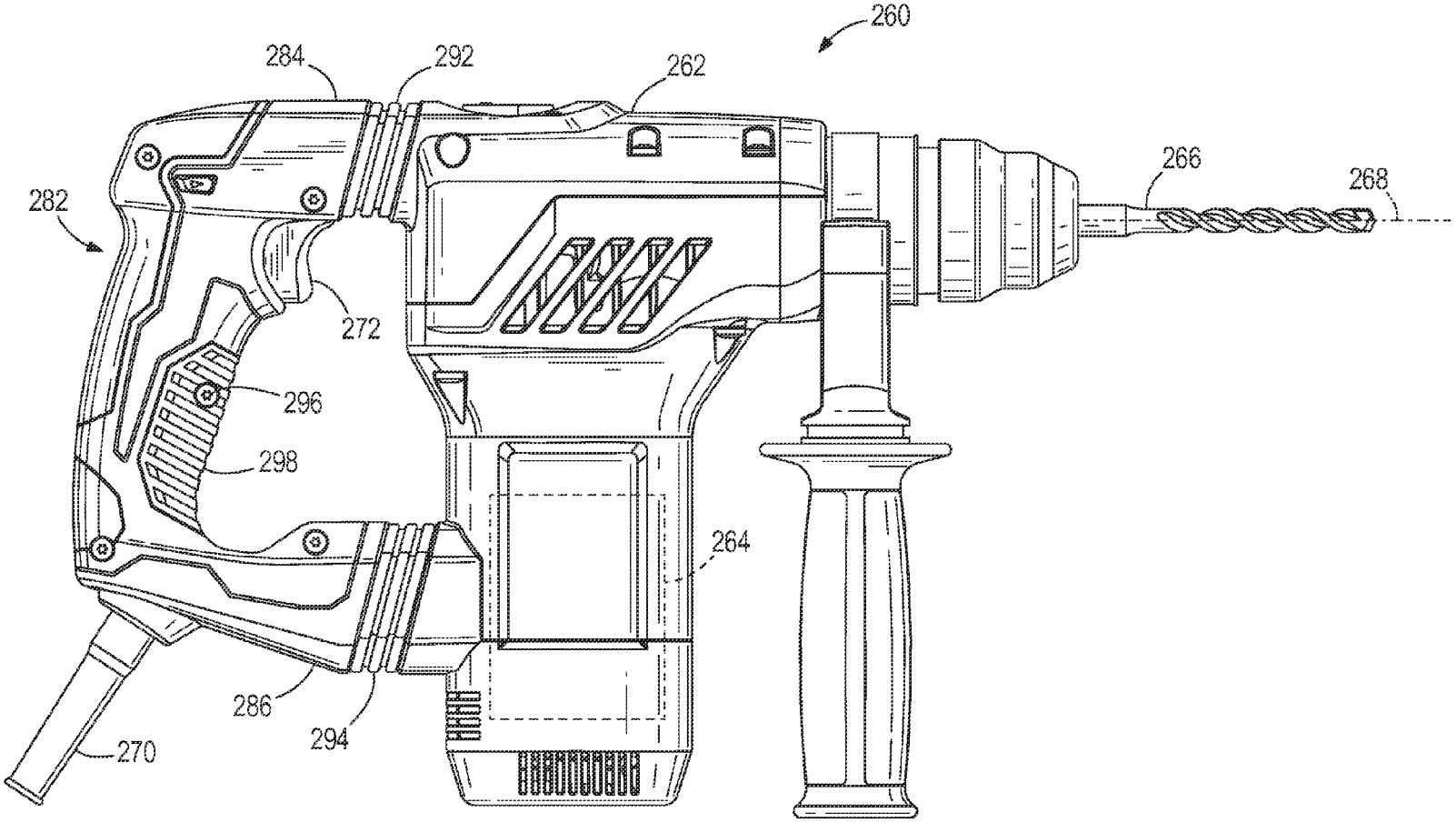
FIG. 18 is a perspective view of a rotary hammer according to yet another embodiment of the invention.

FIGS. 18-23 illustrate a rotary hammer 260 according to yet another embodiment of the invention. With reference to FIG. 18, the rotary hammer 260 includes a housing 262 and a motor 264 disposed within the housing 262. A tool bit 266, defining a working axis 268, is coupled to the motor 264 for receiving torque from the motor 264. In the illustrated embodiment, the motor 264 is powered by a remote power source (e.g., a household electrical outlet) through a power cord 270. Alternatively, the motor 264 may receive power from an on-board power source (e.g., a battery; not shown). The battery may include any of a number of different nominal voltages (e.g., 12V, 18V, etc.), and may be configured having any of a number of different chemistries (e.g., lithium-ion, nickel-cadmium, etc.). The motor 264 is selectively activated by depressing a trigger 272 which, in turn, actuates an electrical switch (not shown). The switch may be electrically connected to the motor 264 via a top-level or master controller, or one or more circuits, for controlling operation of the motor 264.

Figure 19:
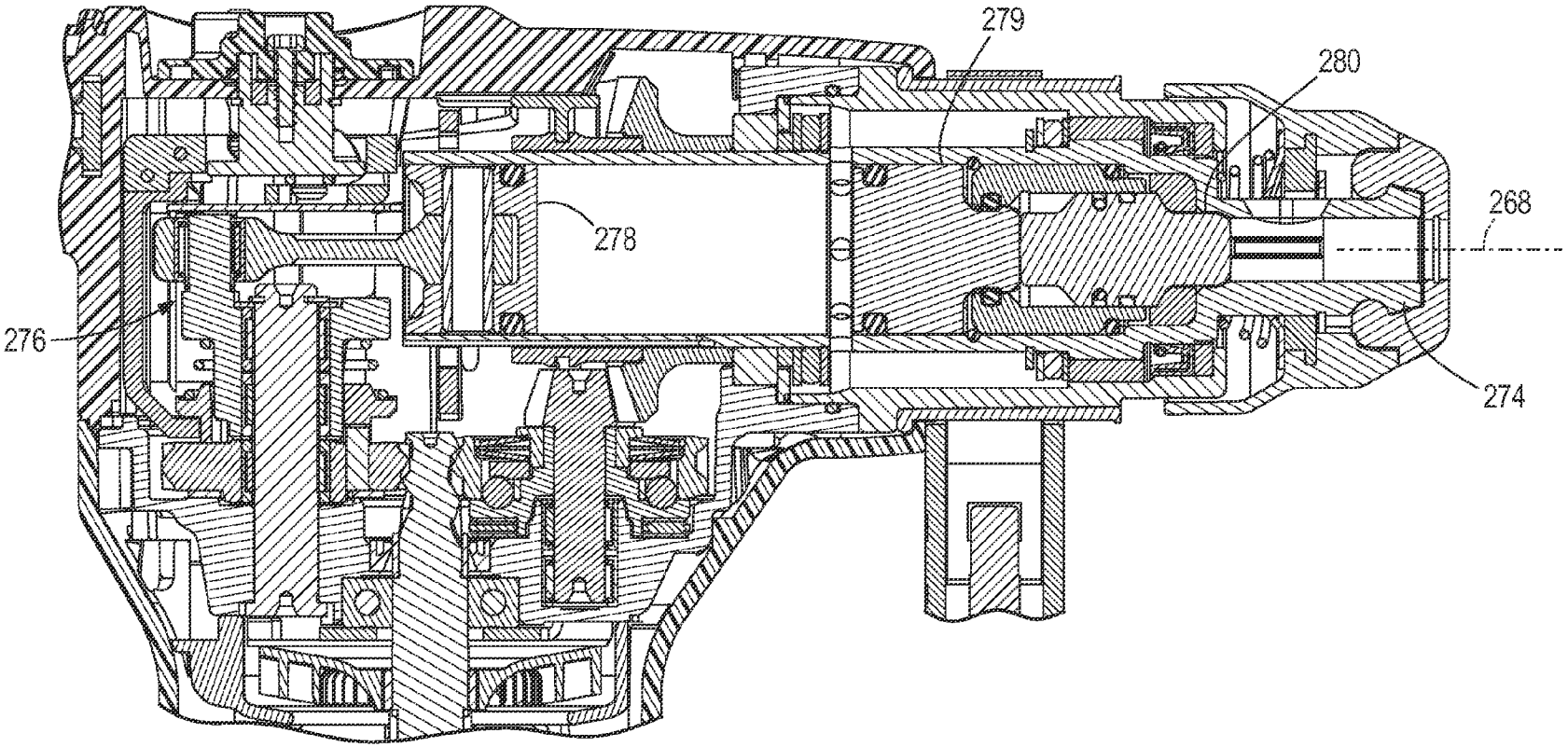
FIG. 19 is a cross-sectional view of a portion of the rotary hammer of FIG. 18.

With reference to FIGS. 18 and 19, the tool bit 266 is secured to a spindle 274 for co-rotation with the spindle 274 (e.g., using a quick-release mechanism). The rotary hammer 260 further includes an impact mechanism 276 having a reciprocating piston 278 disposed within the spindle 274, a striker 279 that is selectively reciprocable within the spindle 274 in response to reciprocation of the piston 278, and an anvil 280 that is impacted by the striker 279 when the striker 279 reciprocates toward the tool bit 266. The impact between the striker 279 and the anvil 280 is transferred to the tool bit 266, causing it to reciprocate for performing work on a work piece. The spindle 274 and the impact mechanism 276 of the rotary hammer 260 can have any suitable configuration for transmitting rotary and reciprocating motion to the tool bit 266, such as the configurations described above with reference to the rotary hammer 10 of FIGS. 1-16 or the rotary hammer of FIG. 17. The synchronizing assembly 82 of FIGS. 3 and 4 may also be utilized in the rotary hammer 260.

Figure 20:
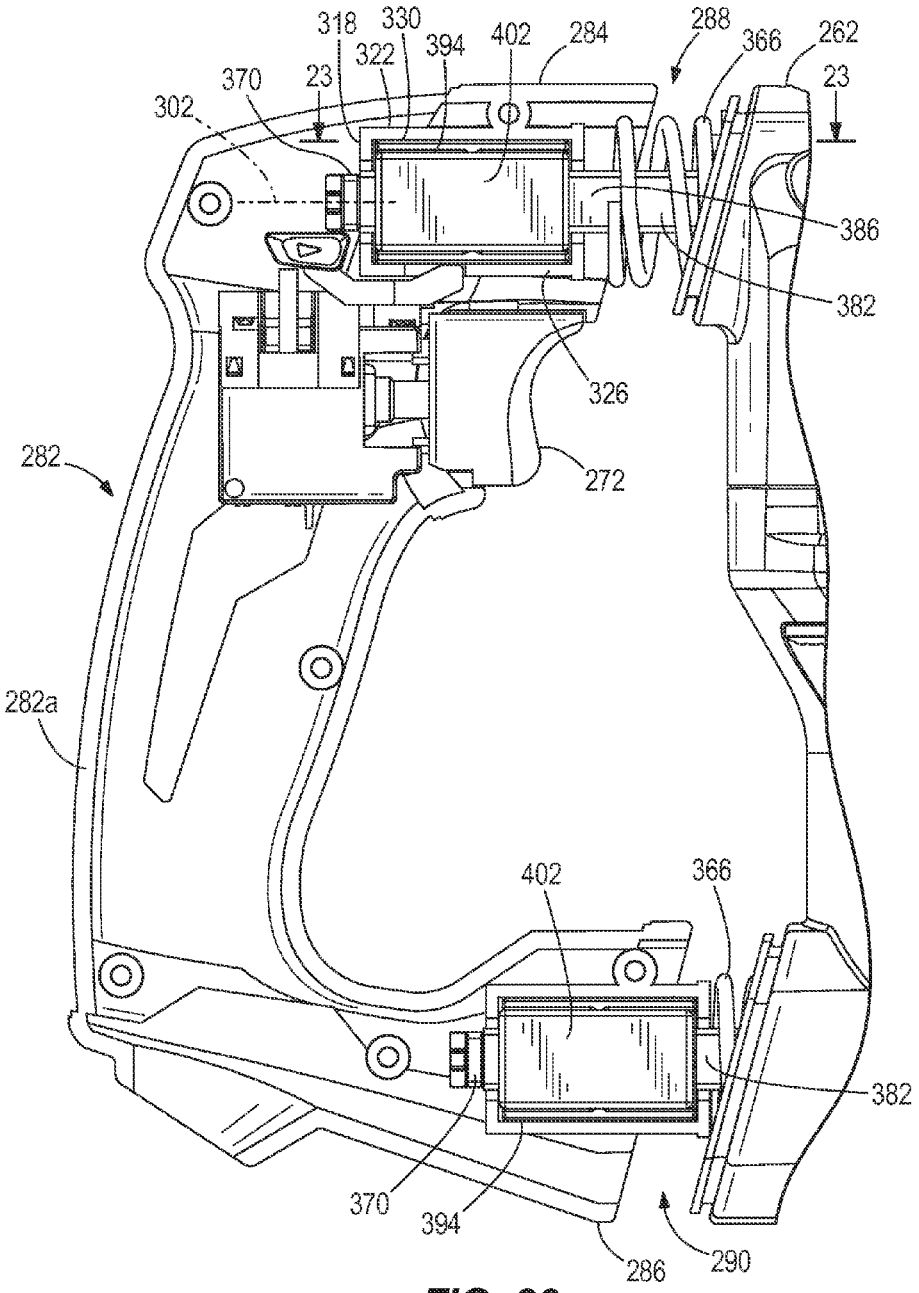
FIG. 20 is a cutaway view of an anti-vibration handle of the rotary hammer of FIG. 18.

With reference to FIG. 20, the rotary hammer 260 further includes a handle 282 having an upper portion 284 and a lower portion 286 coupled to the housing 262 via an upper joint 288 and a lower joint 290, respectively. With reference to FIG. 18, the handle 282 includes an upper bellows 292 disposed between the upper portion 284 and the housing 262, and a lower bellows 294 disposed between the lower portion 286 and the housing 262. The bellows 292, 294 protect the joints 288, 290 from dust or other contamination. The handle 282 is formed from cooperating first and second handle halves 282*a*, 282*b* (FIG. 23) secured together by fasteners 296 (FIG. 18), and the handle 282 includes an overmolded grip portion 298 to provide increased operator comfort. In other embodiments, the handle 282 may be formed as a single piece or may not include the overmolded grip portion 298.

Figure 21:
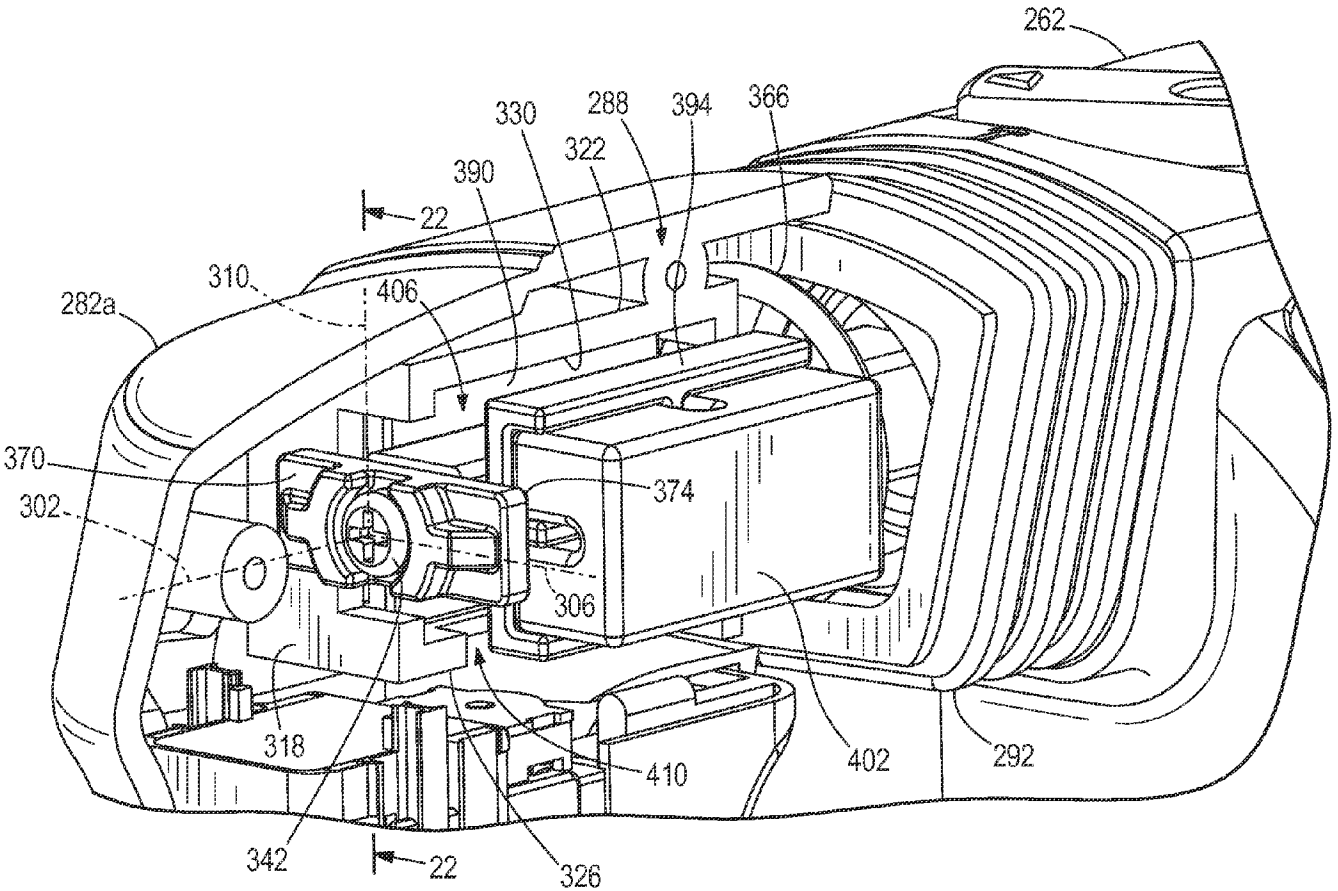
FIG. 21 is a perspective cutaway view of an upper joint of the anti-vibration handle of FIG. 20.

Operation of the rotary hammer 260 may produce vibration at least due to the reciprocating motion of the impact mechanism 276 and intermittent contact between the tool bit 266 and a work piece. Such vibration may generally occur along a first axis 302 parallel to the working axis 268 of the tool bit (FIG. 21). Depending upon the use of the rotary hammer 260, vibration may also occur along a second axis 306 orthogonal to the first axis 302 and along a third axis 310 orthogonal to both the first axis 302 and the second axis 306. To attenuate the vibration being transferred to the handle 282, and therefore the operator of the rotary hammer 260, the upper and lower joints 288, 290 each permit limited movement of the handle 282 relative to the housing 262 in the directions of the first axis 302, the second axis 306, and the third axis 310. For example, the upper and lower joints 288, 290 enable movement of the handle 282 relative to the housing 262 along the first axis 302 between an extended position and a retracted position. The extended position and the retracted position correspond with the respective maximum and minimum relative distances between the handle 282 and the housing 262 during normal operation of the rotary hammer 260. The upper and lower joints 288, 290 are structurally and functionally identical, and as such, only the upper joint 288 is described in detail herein. Like components are identified with like reference numerals.

Figure 22:
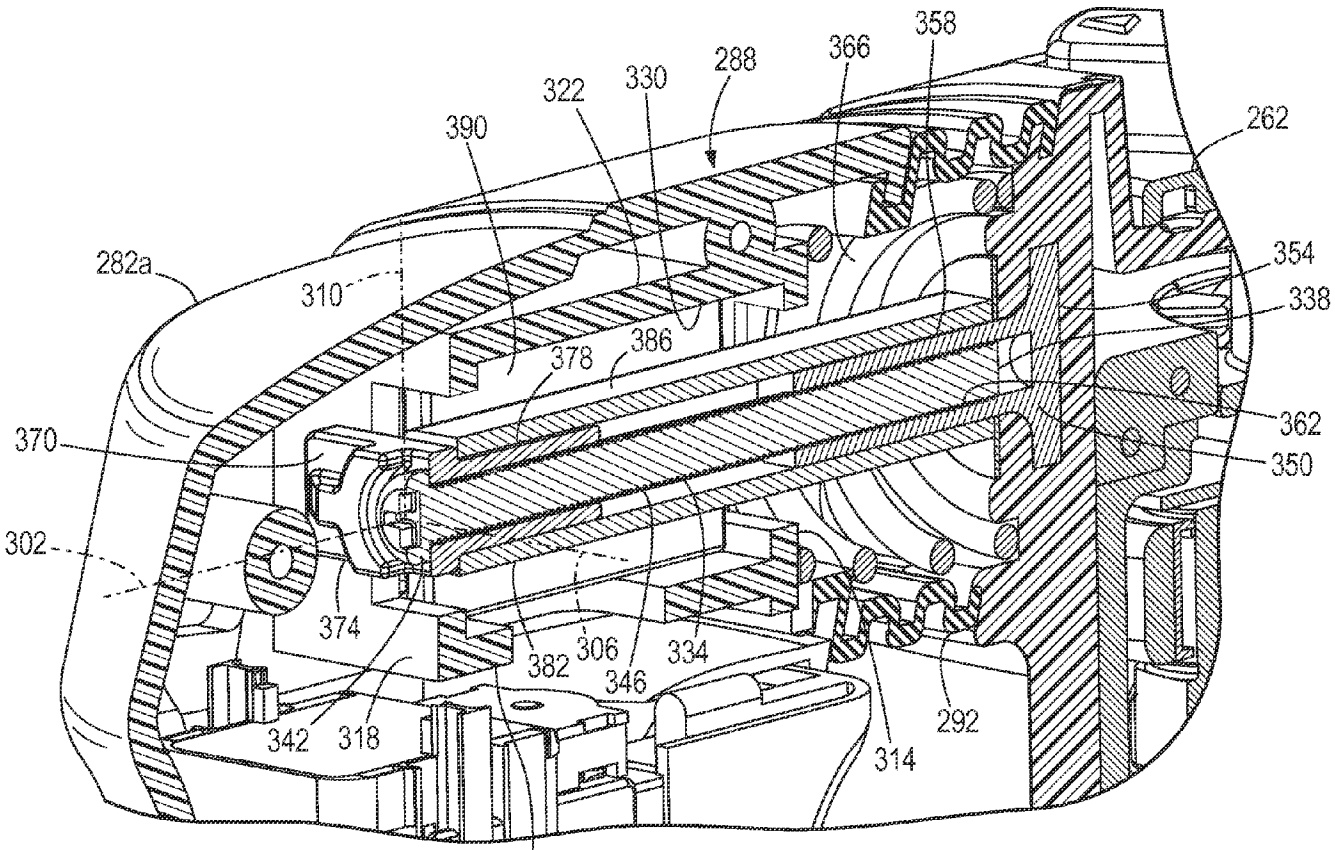
FIG. 22 is a cross-sectional view of the upper joint taken through line 22-22 of FIG. 21.

With reference to FIG. 22, the first and second handle halves 282*a*, 282*b* each include a front wall 314, a rear wall 318, an upper wall 322, and a lower wall 326 that collectively define a cavity 330 when the first and second handle halves 282*a*, 282*b* are attached. The upper joint 288 includes a rod 334 having a distal end 338 coupled to the housing 262, a head 342 opposite the distal end 338, and a shank 346 extending through the cavity 330. The distal end 338 is coupled to the housing 262 by a first, generally T-shaped bracket 350. The bracket 350 includes a rectangular head 354 and a post 358 extending from the head 354. In the illustrated embodiment, the rod 334 is a threaded fastener (e.g., a bolt), and the post 358 includes a threaded bore 362 in which the threaded end 338 of the rod 334 is received. In other embodiments, the rod 334 may be coupled to the bracket 350 in any suitable fashion (e.g., an interference fit, etc.), or the rod 334 may be integrally formed as a single piece with the bracket 350. In the illustrated embodiment, the bracket 350 is coupled to the housing 262 using an insert molding process. Alternatively, the bracket 350 may be coupled to the housing 262 by any suitable method.

With continued reference to FIG. 22, the upper joint 288 includes a biasing member 366 disposed between the upper portion 284 of the handle 282 and the housing 262. The biasing member 366 is deformable to attenuate vibration transmitted from the housing 262 along the first axis 302. In the illustrated embodiment, the biasing member 366 is a coil spring; however, the biasing member 366 may be configured as another type of elastic structure. The upper joint 288 also includes a second, generally T-shaped bracket 370 coupled to the rod 334. The bracket 370 includes a rectangular head 374 and a hollow post 378 extending from the head 374 through which the shank 346 of the rod 334 extends. The head 342 of the rod 334 limits the extent to which the shank 346 may be inserted within the hollow post 378. A sleeve 382, having a generally square cross-sectional shape, surrounds the rod 334 and the posts 358, 378 of the brackets 350, 370 to provide smooth, sliding surfaces 386 (FIG. 23) along the length of the rod 334. The rectangular head 374 of the bracket 370 is configured to abut the rear walls 318 of the respective handle halves 282*a*, 282*b* in the extended position of the handle 282 and to be spaced from the rear walls 318 of the respective handle halves 282*a*, 282*b* as the handle 282 moves towards the retracted position.

Figure 23:
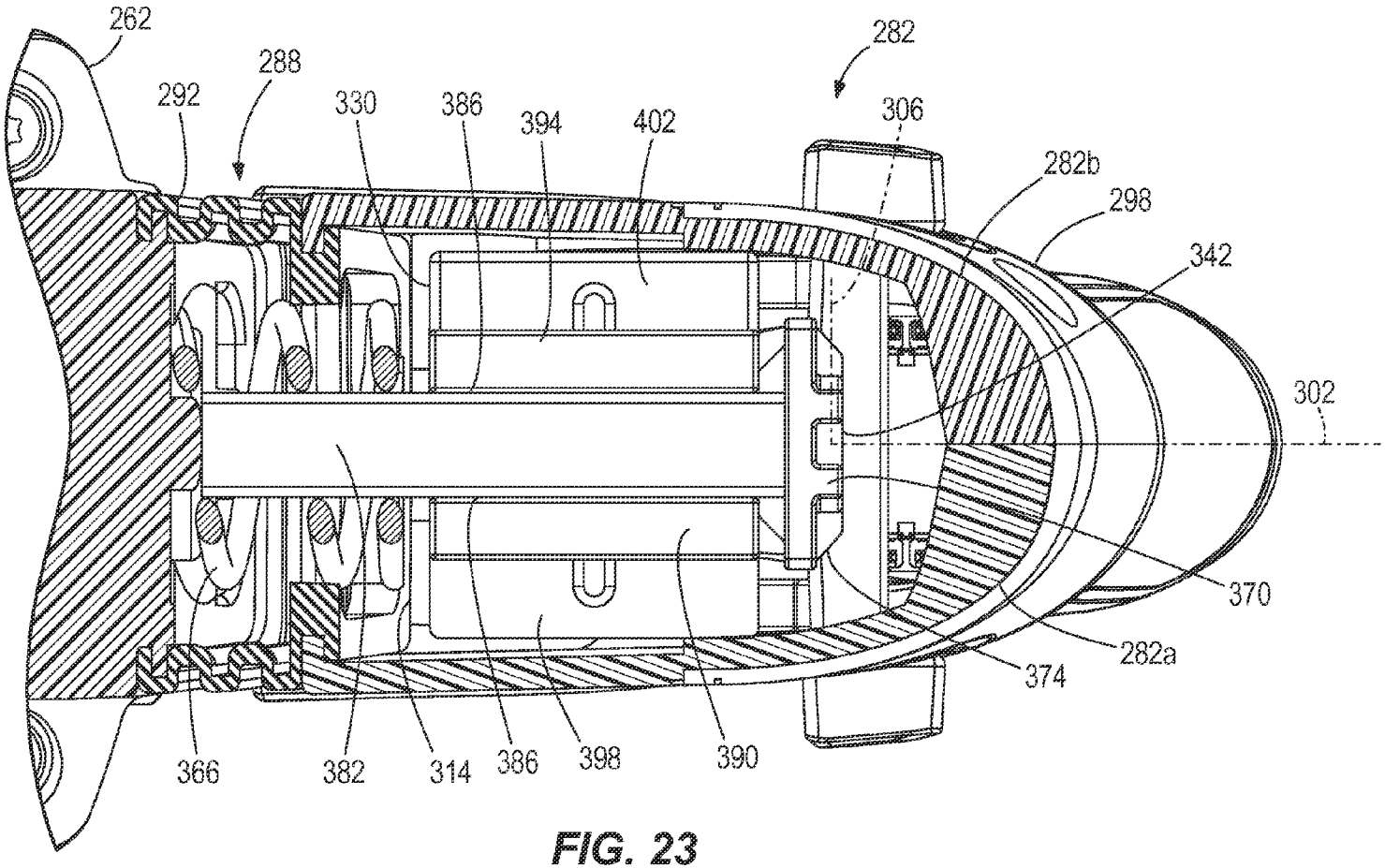
FIG. 23 is a cross-sectional view of the upper joint taken through line 23-23 of FIG. 20.

With continued reference to FIG. 23, the upper joint 288 also includes a first guide 390 and a second guide 394 positioned within the cavity 330 on opposing sides of the sleeve 382. The guides 390, 394 are constrained within the cavity 330 along the first axis 302 by the front and rear walls 314, 318 of the handle halves 282*a*, 282*b* such that the guides 390, 394 move with the handle 282 along the sliding surfaces 386 of the sleeve 382 as the handle 282 moves along the first axis 302. A first bumper 398 is disposed within the cavity 330 between the first guide 390 and the first handle half 282*a*, and a second bumper 402 is disposed within the cavity 330 between the second guide 394 and the second handle half 282*b*. The bumpers 398, 402 are formed from an elastic material (e.g., rubber) and are deformable to allow the handle 282 to move relative to the housing 262 a limited extent along the second axis 306 (see also FIG. 22). The bumpers 398, 402 resist this movement, thereby attenuating vibration transmitted from the housing 262 to the handle 282 along the second axis 306.

With reference to FIG. 21, the upper joint 288 includes a gap 406 between the sleeve 382 and the upper walls 322 of the handle halves 282*a*, 282*b*, and another gap 410 between the sleeve 382 and the lower walls 326 of the handle halves 282*a*, 282*b*. The gaps 406, 410 allow the guides 390, 394 to slide relative to the sleeve 382 a limited extent along the third axis 310. The gaps 406, 410 therefore allow the handle 282 to move relative to the housing 262 a limited extent along the third axis 310. The biasing member 366 resists shearing forces developed by movement of the handle 282 along the third axis 310, thereby attenuating vibration transmitted to the handle 282 along the third axis 310. In addition, the upper bellows 292 is formed from a resilient material and further resists the shearing forces developed by movement of the handle 282 along the third axis 310, thereby providing additional vibration attenuation. Similarly, the lower bellows 294 attenuates vibration transmitted to the handle 282 along the third axis 310 in conjunction with the lower joint 290.

In operation of the rotary hammer 260, vibration occurs along the first axis 302, the second axis 306, and/or the third axis 310 depending on the use of the rotary hammer 260. When the handle 282 moves relative to the housing 262 along the first axis 302 between the extended position and the retracted position, and the biasing member 366 of each of the joints 288, 290 expands and compresses accordingly to attenuate the vibration occurring along the first axis 302. Additionally, the bumpers 398, 402 of each of the joints 288, 290 elastically deform between the handle halves 282*a*, 282*b* and the guides 390, 394, respectively, to permit limited movement of the handle 282 relative to the housing 262 along the second axis 306, thereby attenuating vibration occurring along the second axis 306. Finally, the gaps 406, 410 defined by each of the joints 288, 290 allow for limited movement of the handle 282 relative to the housing 262 along the third axis 310, and the biasing member 366 and the upper and lower bellows 292, 294 resist the resulting shearing forces to attenuate the vibration occurring along the third axis 310.

Various features of the invention are set forth in the following claims.

What is claimed is:

1. A rotary power tool comprising:
a housing;
a tool element defining a working axis;
a handle coupled to the housing and movable along a first axis parallel with the working axis between a retracted position and an extended position relative to the housing, the handle including an upper portion and a lower portion;
an upper joint coupling the upper portion of the handle to the housing; and
a lower joint coupling the lower portion of the handle to the housing, each of the upper and lower joints including a rod extending into the handle and a biasing member disposed between the handle and the housing, the biasing member operable to bias the handle toward the extended position,
wherein each of the upper and lower joints is operable to attenuate vibration transmitted along the first axis and along a second axis orthogonal to the first axis,
wherein each of the upper and lower joints further includes a first guide and a second guide disposed on opposing sides of the rod, the first and second guides being slidable along the rod as the handle moves between the extended position and the retracted position, and
wherein each of the upper and lower joints further includes a first bumper disposed between the first guide and the handle and a second bumper disposed between the second guide and the handle, the first bumper and the second bumper operable to attenuate vibration transmitted along the second axis.

2. The rotary power tool of claim 1, wherein each of the upper and lower joints further includes a first bracket fixed to one of the housing and the rod and a second bracket coupled to the other of the housing and the rod.

3. The rotary power tool of claim 2, wherein at least one of the first bracket and the second bracket limits movement of the handle to the extended position.

4. The rotary power tool of claim 2, wherein the first bracket and the second bracket are generally T-shaped.

5. The rotary power tool of claim 2, wherein the first bracket is coupled to the housing using an insert molding process.

6. The rotary power tool of claim 1, wherein each of the upper and lower joints further includes a sleeve at least partially surrounding the rod and disposed between the rod and the first and second guides.

7. The rotary power tool of claim 6, wherein the sleeve has a generally square cross-sectional shape.

8. The rotary power tool of claim 1, wherein the biasing member attenuates vibration transmitted along the first axis.

9. The rotary power tool of claim 1, wherein the biasing member is a coil spring.

10. The rotary power tool of claim 1, wherein each of the upper and lower joints further includes a gap above and/or below the rod to permit limited movement of the handle relative to the housing along a third axis, the third axis being orthogonal to both the first axis and the second axis.

11. The rotary power tool of claim 10, wherein the biasing member attenuates vibration transmitted along the third axis.

12. The rotary power tool of claim 10, further comprising an upper bellows surrounding at least a portion of the upper joint and a lower bellows surrounding at least a portion of the lower joint, wherein the upper bellows and the lower bellows attenuate vibration transmitted along the third axis.

13. The rotary power tool of claim 1, wherein the handle includes first and second handle halves, wherein the first bumper is disposed between the first guide and the first handle half, and wherein the second bumper is disposed between the second guide and the second handle half.

14. The rotary power tool of claim 13, wherein each of the first and second handle halves includes a front wall, a rear wall, an upper wall, and a lower wall that collectively define a cavity.

15. The rotary power tool of claim 14, wherein the first and second guides are disposed within the cavity.

16. The rotary power tool of claim 14, wherein each of the upper and lower joints further includes a first gap between the upper wall and the rod and a second gap between the lower wall and the rod, the first and second gaps permitting limited movement of the handle relative to the housing along a third axis, the third axis being orthogonal to both the first axis and the second axis.

17. The rotary power tool of claim 16, wherein the biasing member is configured to resist shearing forces developed by movement of the handle relative to the housing along the third axis.

18. The rotary power tool of claim 16, wherein the first bumper and the second bumper are disposed within the cavity.

19. The rotary power tool of claim 16, wherein the first and second guides are constrained within the cavity along the first axis by the front wall and the rear wall.

20. The rotary power tool of claim 1, wherein the first and second guides are coupled to the handle for movement therewith along the first axis.

* * * * *